US010704853B2

(12) United States Patent
Geissele et al.

(10) Patent No.: US 10,704,853 B2
(45) Date of Patent: Jul. 7, 2020

(54) TRIGGER ASSEMBLIES FOR FIREARMS

(71) Applicant: WHG Properties, LLC, North Wales, PA (US)

(72) Inventors: William H. Geissele, Lower Gwynedd, PA (US); David Duhaime, Ivyland, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/167,012

(22) Filed: Oct. 22, 2018

(65) Prior Publication Data

US 2020/0064095 A1 Feb. 27, 2020

Related U.S. Application Data

(60) Provisional application No. 62/722,584, filed on Aug. 24, 2018.

(51) Int. Cl.

| | |
|---|---|
| ***F41A 19/16*** | (2006.01) |
| ***F41A 17/72*** | (2006.01) |
| *F41A 3/66* | (2006.01) |

(52) U.S. Cl.

CPC ..... *F41A 17/72* (2013.01); *F41A 3/66* (2013.01)

(58) Field of Classification Search

CPC ..... F41A 19/16; F41A 19/10; F41A 19/00; F41A 19/17; F41A 17/72

See application file for complete search history.

(56) References Cited

U.S. PATENT DOCUMENTS

| | | | | |
|---|---|---|---|---|
| 6,772,548 | B1 * | 8/2004 | Power | F41A 19/10 42/69.03 |
| 2006/0086031 | A1 * | 4/2006 | Geissele | F41A 19/16 42/69.03 |
| 2014/0311006 | A1 * | 10/2014 | Kott | F41A 19/16 42/69.01 |
| 2017/0299306 | A1 * | 10/2017 | Larson, Jr. | F41A 19/16 |
| 2018/0202740 | A1 * | 7/2018 | Elftmann, Jr. | F41A 19/15 |

* cited by examiner

*Primary Examiner* — J. Woodrow Eldred
(74) *Attorney, Agent, or Firm* — Fox Rothschild LLP

(57) ABSTRACT

Trigger assemblies are provided for restraining a firing pin of a firearm on a selective basis. The triggers assemblies include a first and a second lever mounted for rotation within a housing. The first lever is configured to be rotated by the user, and rotation of the first lever imparts rotation to the second lever to initiate the discharge of the firearm. The trigger assemblies also include a safety mechanism having a safety lever that is movable between a first and a second angular position. The safety lever is configured to prevent movement of the first and second levers when the safety lever is in its first angular position, thereby preventing discharge of the firearm.

12 Claims, 19 Drawing Sheets

TRIGGER ASSEMBLIES FOR FIREARMS

CROSS-REFERENCE TO RELATED APPLICATION

This application claims the benefit of priority to U.S. Provisional Patent Application No. 62/722,584 filed Aug. 24, 2018, the disclosure of which is hereby incorporated by reference in its entirety.

FIELD

The inventive concepts disclosed herein relate to trigger assemblies for initiating the firing sequence in firearms such as bolt action rifles.

BACKGROUND

Firearms such a rifles and handguns typically include a trigger assembly by which the user initiates the firing sequence that results in the discharge of the firearm. A trigger assembly configured for use with a bolt-action rifle commonly includes a mechanism for restraining a spring-loaded firing pin that, when released, strikes a primer of an unfired cartridge located in a chamber of the rifle. The impact ignites the primer, which in turn ignites a propellant within the cartridge. The expanding propellant drives a projectile from a casing of the cartridge and through a barrel of the firearm so that the projectile exits the rifle via the muzzle of the barrel.

The trigger assembly restrains the firing pin until the user actuates the trigger assembly by pulling or otherwise exerting pressure on a rotating or linear-motion trigger. Pulling the trigger initiates a series of mechanical interactions within the trigger assembly that result in the release of the firing pin.

The trigger assembly is critical to the safe, reliable, and accurate operation of the rifle. For example, the trigger assembly needs to securely restrain the firing pin so as to minimize the potential for an accidental discharge of the rifle. Configuring the trigger assembly to avoid an accidental discharge, however, can give the trigger assembly undesirable characteristics. The degree of restraint on the firing pin can be increased, and the potential for an accidental discharge decreased, by increasing the friction and the overlap between the various components within the trigger assembly that interact to restrain the firing pin. Increasing the friction and overlap between components, however, can increase the trigger pull weight, i.e., the amount of force that needs to be applied to the trigger; can make the trigger pull rough and uneven; and can increase the distance through which the trigger must be pulled to initiate the firing sequence. These factors can diminish the accuracy and reliability of the rifle; can result in premature wear of the trigger assembly; and can cause fatigue, discomfort, and injury to the user.

Trigger assemblies typically include some type of safety mechanism that further reduces the potential for an accidental discharge when the rifle is not in use. Safety mechanisms usually function by blocking or otherwise interfering with the movement of a single component within the trigger assembly, so that the trigger assembly cannot be actuated. Blocking a single component, however, may be not be sufficient to prevent an accidental discharge, especially when the rifle is dropped or otherwise subjected to some type of impact. On the other hand, a safety mechanism that interferes with the movement of multiple components may be too large, and may require the user to manipulate more than one lever or button to fully engage and disengage the mechanism.

The space allocated for the trigger assembly within a rifle typically is limited, which in turn limits the overall dimensions of the trigger assembly. Also, trigger assemblies are exposed to dirt, carbon, and other contaminants during normal use, and thus need to be cleaned and lubricated on a periodic basis. Trigger assemblies that require significant disassembly to clean and lubricate, or that otherwise are difficult to maintain, often do not receive a proper degree of maintenance.

SUMMARY

The present disclosure relates generally to trigger assemblies for initiating the discharge of a firearm.

In one aspect, the disclosed technology relates to trigger assemblies for restraining a firing pin of a firearm on a selective basis. The trigger assemblies include a housing, a first lever mounted for rotation on the housing and movable between a first and a second angular position, and a second lever mounted for rotation on the housing and movable between a first and a second angular position. The first lever is configured to move the second lever from the first to the second angular position of the second lever when the first lever moves from the first to the second angular position of the first lever.

The trigger assemblies also include a safety mechanism. The safety mechanism has a safety lever mounted for rotation in relation to the housing and movable between a first and a second angular position. The safety lever is configured to prevent movement of the first lever from the first to the second angular position of the first lever, and movement of the second lever from the first to the second angular position of the second lever, when the safety lever is in its first angular position.

In another aspect, the disclosed technology relates to other trigger assemblies for restraining a firing pin of a firearm on a selective basis. These trigger assemblies include a housing, and a first lever mounted for rotation on the housing and movable between a first and a second angular position. The trigger assemblies also include a second lever mounted for rotation on the housing and movable between a first and a second angular position. The first lever is configured to move the second lever from the first to the second angular position of the second lever when the first lever moves from the first to the second angular position of the first lever.

The trigger assemblies also include a first and a second adjustment screw mounted on the first lever. The first lever is further configured to move the second lever from the first to the second angular position of the second lever via at least one of the first and the second adjustment screws. The second lever and the second adjustment screw are configured so that a distance between an axis of rotation of the second lever and a point of contact between the second lever and the second adjustment screw decreases as the second lever rotates from the first angular position and toward the second angular position of the second lever.

BRIEF DESCRIPTION OF THE DRAWINGS

Embodiments will be described with reference to the following drawing figures, in which like reference numerals represent like parts and assemblies throughout the several views.

DETAILED DESCRIPTION

The inventive concepts are described with reference to the attached figures. The figures are not drawn to scale and are provided merely to illustrate the instant inventive concepts. The figures do not limit the scope of the present disclosure. Several aspects of the inventive concepts are described below with reference to example applications for illustration. It should be understood that numerous specific details, relationships, and methods are set forth to provide a full understanding of the inventive concepts. One having ordinary skill in the relevant art, however, will readily recognize that the inventive concepts can be practiced without one or more of the specific details or with other methods. In other instances, well-known structures or operation are not shown in detail to avoid obscuring the inventive concepts.

FIGS. 1-31C depict a trigger assembly 10, and various components thereof. The trigger assembly 10 can be used in a firearm such as a rifle 100 shown in FIG. 1. The rifle 100 can be a Remington Model 700 bolt-action rifle. This particular application is disclosed for exemplary purposes only; the trigger 10 can be used in other types of bolt-action rifles.

Figure 1:
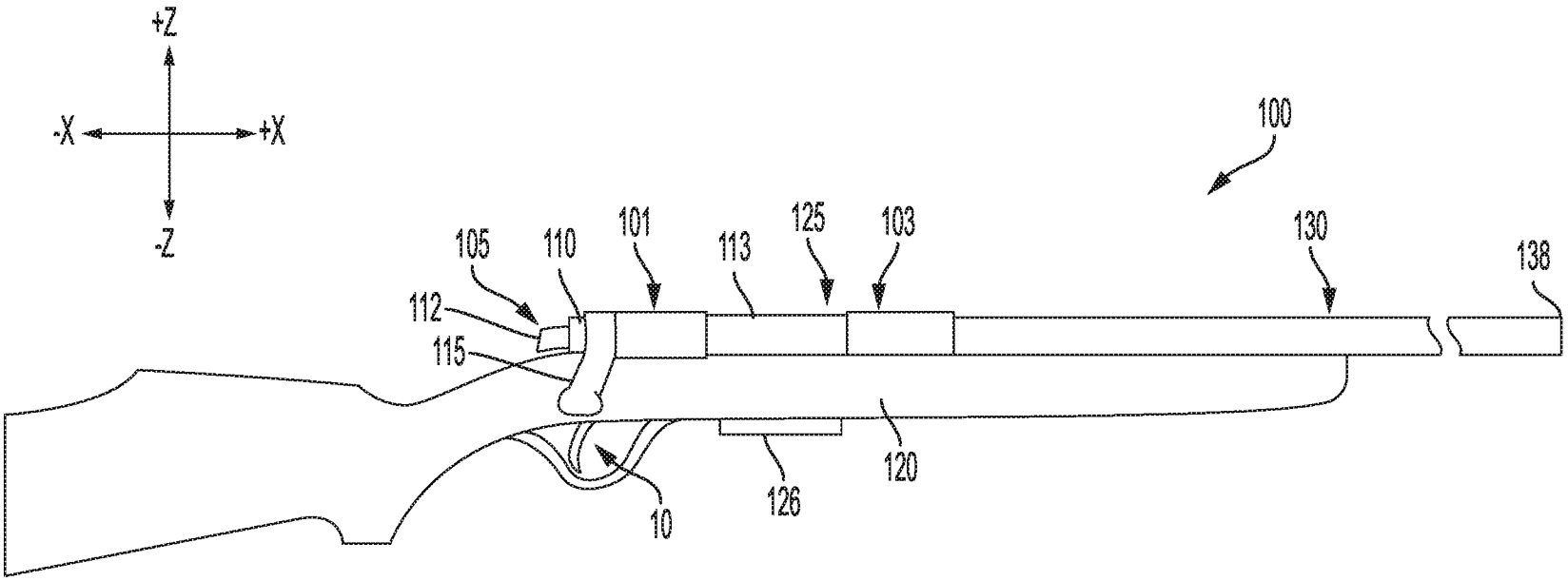
FIG. 1 is side view of a rifle having a trigger assembly as described below.

Referring to FIG. 1, the rifle 100 comprises an action 101. The action 101 is a rotating bolt action, and comprises a bolt assembly 102; a receiver 103; and a striker 105. The receiver 103 is mounted on a stock 120 of the rifle, and houses the bolt assembly 102. The bolt assembly 102 is movable within the receiver 103 between a forward, or closed position shown in FIG. 1, and a rearward, or open position. The bolt assembly 102 includes a bolt body 113, a bolt head (not shown) secured to a forward end of the bolt body 113, and a bolt handle 115 secured to a rearward end of the bolt body 113.

The striker 105 includes a firing pin 106, a spring (not shown), a bolt shroud 110, and a cocking piece 112. The bolt shroud 110 is secured to a rearward end of the bolt body 113, and travels with the bolt assembly 102. The firing pin 106 extends through the bolt shroud 110; and moves linearly, in the forward and rearward, or "x" directions, in relation to the bolt shroud 110. The spring is positioned around the firing pin 106. A rearward end of the spring is secured to a forward end of the bolt shroud 110. A forward end of the spring is secured to the firing pin 106 near a forward end of the firing pin 106 so that the spring is compressed, which in turn biases the firing pin 106 in the forward direction.

The cocking piece 112 is located behind the bolt shroud 110; and is secured to a rearward end of the firing pin 106. The cocking piece 112 is biased in the forward direction, into abutment with the bolt shroud 110, due to its attachment to the forwardly-biased firing pin 106. The cocking piece 112 acts as a forward stop for the firing pin 106.

Following discharge of the rifle 10, an unfired cartridge is introduced into the action 101 by moving the bolt assembly 102 from its closed to its open position. To move the bolt assembly 102, the user grasps the bolt handle 115, and rotates the bolt assembly 102 approximately 90 degrees in relation to the receiver 103 to align the bolt handle 115 with the open top of the receiver 103. The bolt handle 115 then can be pulled rearward by the user to move the bolt assembly 102 rearward, until the bolt assembly 102 is restrained from further rearward movement by contact with a bolt stop (not shown).

The empty casing of the fired cartridge is carried rearward with the bolt assembly 102. As the bolt assembly 102 nears its rearward position, an ejector (not shown) located on the bolt head strips the empty casing from the bolt assembly 102 and ejects the casing through a loading ejection port 125 in the receiver 103. An unfired cartridge is then introduced into the receiver 103, forward of the bolt head. The unfired cartridge is introduced under spring force, from a magazine 126 located below the action 101.

Once the unfired cartridge has been fed into the receiver 103, the user pushes the bolt assembly 102 forward, toward its cocked position. The bolt head contacts the unfired cartridge and pushes the cartridge forward as the bolt assembly 102 moves toward its closed position. As the bolt assembly 102 and the attached striker 105 move forward, a lip 127 on the cocking piece 112 catches on a transfer bar 21 of the trigger assembly 10, as shown schematically in FIG. 11. The transfer bar 21 restrains the cocking piece 112, and the attached firing pin 106, from further forward movement.

As the bolt assembly 102 and the attached bolt shroud 110 move further forward, the rearward end of the spring of the striker 105, which is attached to the bolt shroud 110, continues to move forward as the forward end of the spring, which is attached to the now stationary firing pin 106, does not. The spring therefore becomes further compressed. As the bolt assembly 102 reaches its forward position, it pushes the unfired cartridge into a barrel chamber (not shown) of a barrel 130 of the rifle 100.

Figure 11:
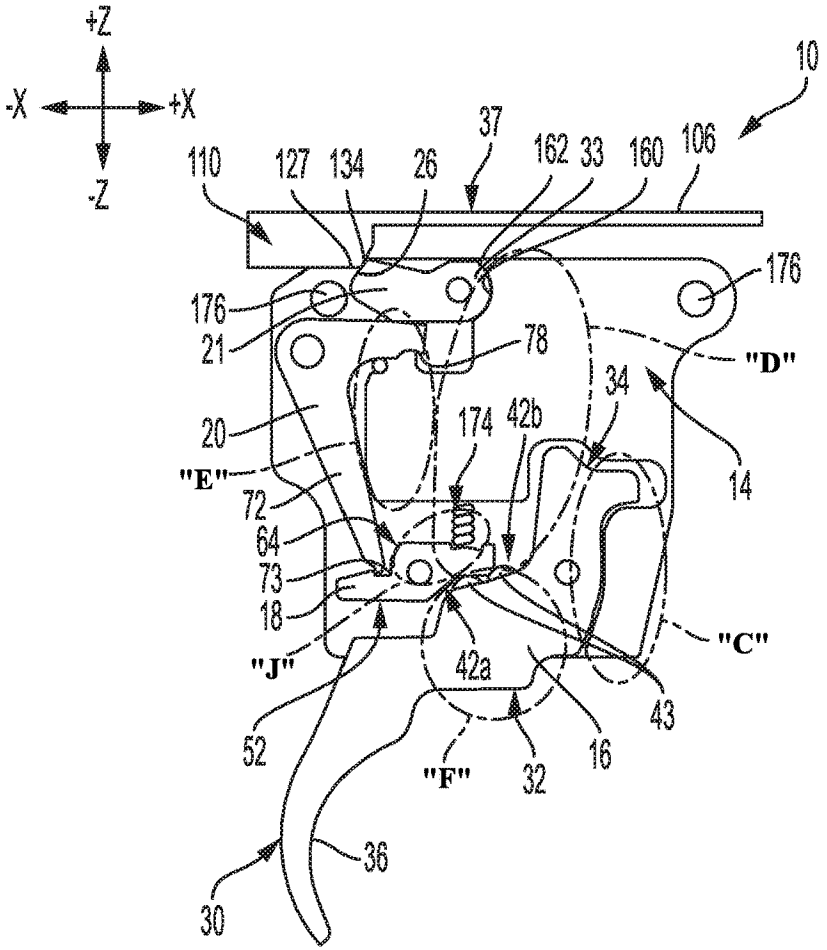
FIG. 11 is a right side view of the trigger assembly shown in FIGS. 2-10, with a cover plate of the trigger assembly removed, and depicting the trigger assembly in a cocked condition ready to be actuated.

Once the bolt assembly 102 has reached the forward end of its travel, the user rotates the bolt assembly 102 approximately 90 degrees so that a portion of the bolt handle 115 becomes disposed in a notch formed in the stock 120, thereby securing the bolt assembly 102 in its closed position. The spring of the striker 105 is fully compressed at this point and is exerting its maximal force on the firing pin 106, which is being held in its cocked position by the transfer bar 21 of the trigger assembly 10, as shown in FIG. 11.

Figure 12:
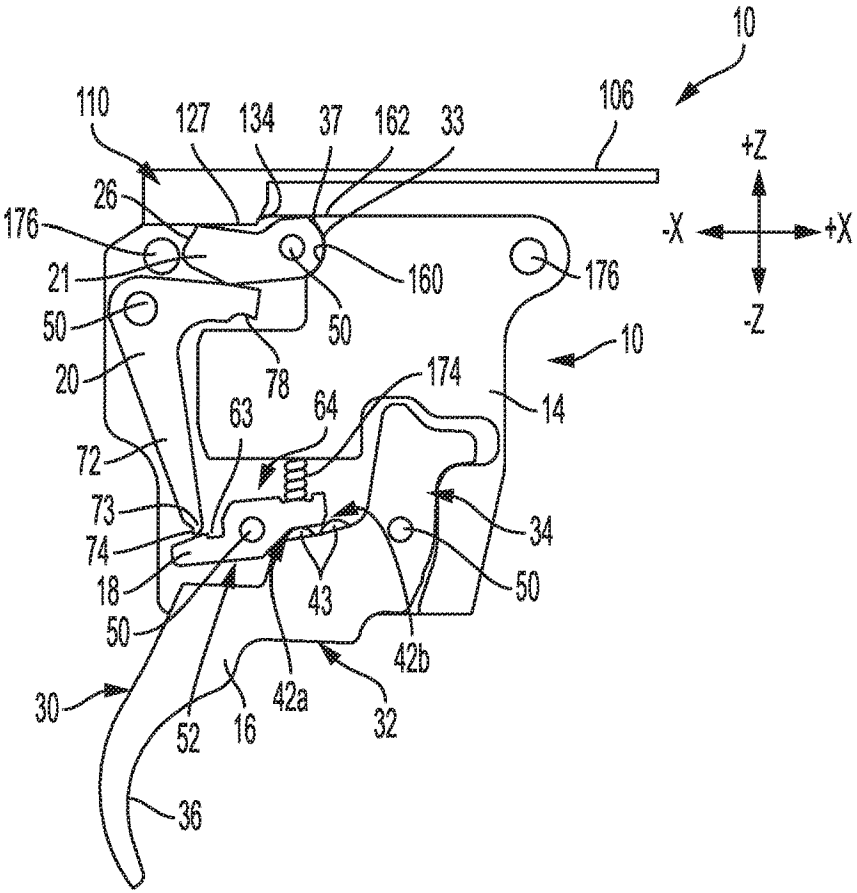
FIG. 12 is a right side view of the trigger assembly shown in FIGS. 2-11, with the cover plate removed, and depicting the trigger assembly immediately following actuation.

Actuation of the trigger assembly 10 at this point causes the transfer bar 21 to release the cocking piece of the striker 105, which in turn allows the firing pin 106 to move forward under the bias of the spring of the striker 105 as can be seen in FIG. 12. A forward end of the firing pin 106 subsequently strikes the rearward end of the cartridge, which ignites an impact-sensitive primer in the cartridge. The primer, upon be struck, ignites a propellant within the cartridge. The expanding propellant gas propels a projectile of the cartridge out of the barrel chamber, and into and through a bore formed in the barrel 130 adjacent to the barrel chamber. The projectile subsequently exits the open end, or muzzle 138 of the barrel 130.

Structure of the Trigger Mechanism

The trigger assembly 10 comprises a housing 12, and a cover plate 14 that mates with the housing 12. The trigger assembly 10 is attached to the receiver 103 by two press fit pins that extend through apertures 176 in the housing 12 and the cover plate 14. The assembly 10 also comprises a first lever in the form of a trigger lever 16; a second lever in the form of a re-cocking lever 18; a third lever in the form of a sear lever 20; and a fourth lever in the form of the transfer bar 21, each of which is pivotally mounted on the housing 12 and the cover plate 14. The trigger lever 16, re-cocking lever 18, sear lever 20, and transfer bar 21 interact mechanically in a manner that causes the firing pin 106 of the striker 105 to be restrained in its cocked position until the trigger assembly 10 is actuated by the user.

a. Trigger Lever

Figure 7:
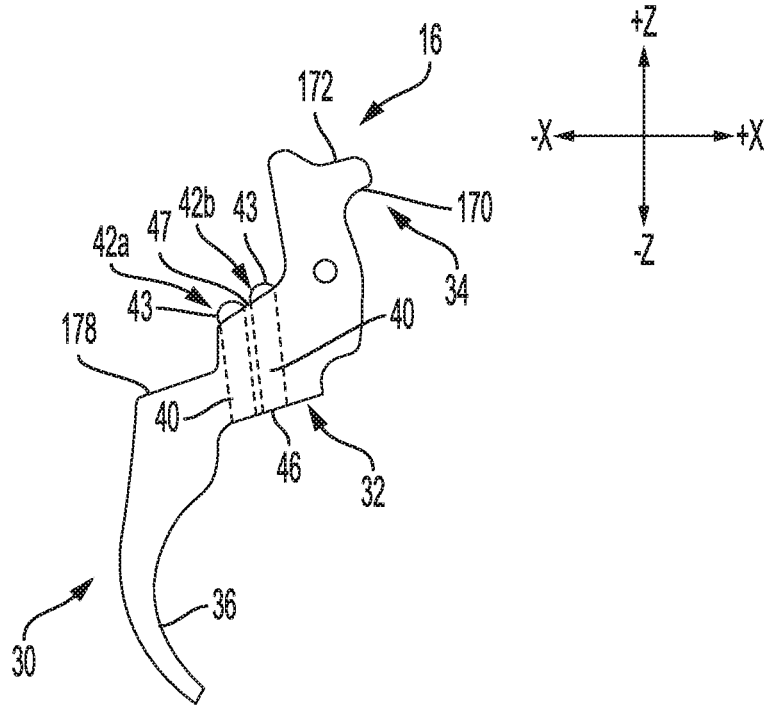
FIG. 7 is a side view of a trigger lever of the trigger assembly shown in FIGS. 2-6.

Referring to FIG. 7, the trigger lever 16 has a first portion 30, an adjoining second portion 32, and a third portion 34 that adjoins the second portion 32. The first portion 30 is elongated, and extends generally downward. The first portion 30 has a substantially flat, generally forward-facing surface 36. The surface 36 acts as a contact surface against which the user exerts pressure to rotate the trigger lever 16 and initiate the firing sequence for the rifle 100, as discussed below.

Figure 25:
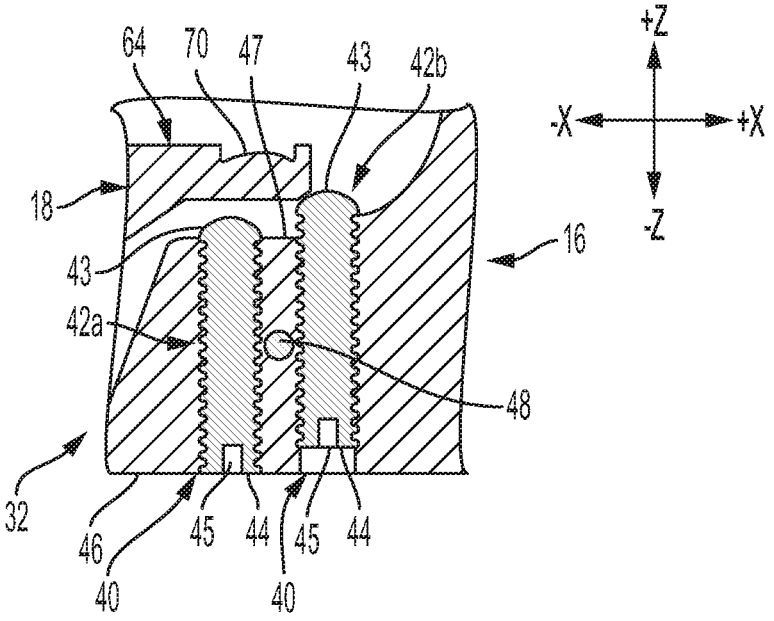
FIG. 25 is a cross-sectional view of the area designated "F" in FIG. 11, taken perpendicular to the "x" and "z" axes.

Referring to FIG. 25, the second portion 32 has two threaded passages 40 formed therein. A first of the passages 40 receives a first adjustment screw 42*a*. A second of the passages 40 receives a second adjustment screw 42*b*. The first and second adjustment screws 42*a*, 42*b* each have exterior threads configured to engage the threads within their associated passages 40. This feature facilitates adjustment of the positions of the first and second adjustment screws 42*a*, 42*b* within the passages 40. The first and second adjustment screws 42*a*, 42*b* each have a spherical upper end 43, and a lower end 44. A recess 45 is formed in the lower ends 44 thereof. The recesses 45 are configured to receive a hex key, to facilitate rotation of the first and second adjustment screws 42*a*, 42*b*. Other means for facilitating rotation of the first and second adjustment screws 42*a*, 42*b* can be used in the alternative.

The lower ends 44 of the first and second adjustment screws 42*a*, 42*b* are located proximate a lower surface 46 of the second portion 32 of the trigger lever 16. The upper ends 43 of the first and second adjustment screws 42*a*, 42*b* are located proximate an upper surface 47 of the second portion 32. The positions of the upper ends 43 in relation to the upper surface 47 are adjustable by rotating the first and second adjustment screws 42*a*, 42*b* within their associated passages 40. As discussed below, the positions of the upper ends 43 can be adjusted to vary the characteristics of the trigger pull of the trigger assembly 10.

A nylon ball 48 is positioned within the second portion 32 of the trigger lever 16. The ball 48 contacts the threads of the first and second adjustment screws 42*a*, 42*b*. This contact discourages the first and second adjustment screws 42*a*, 42*b* from rotating out of adjustment once their positions have been set.

Figure 4:
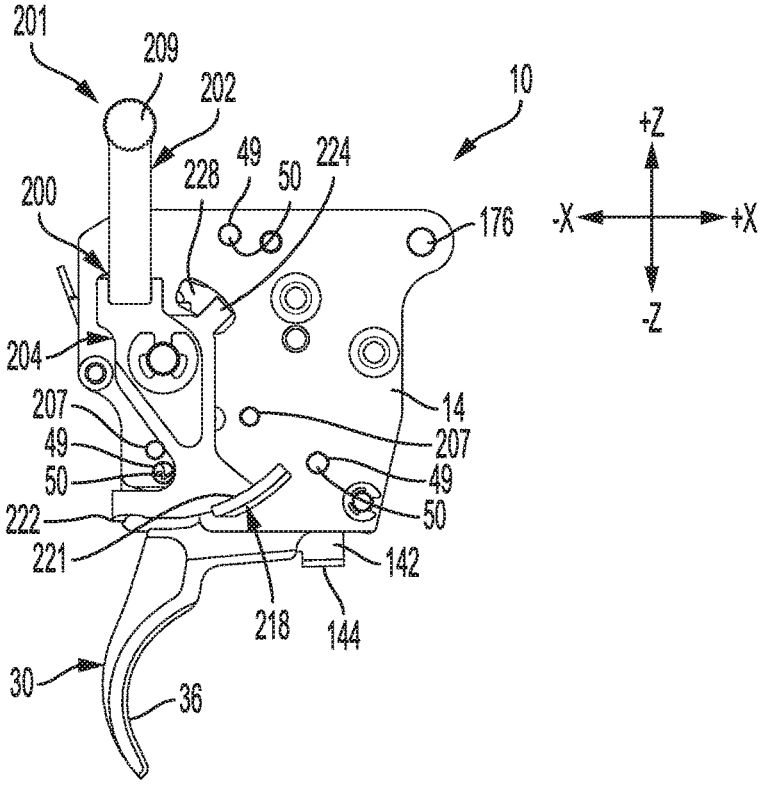
FIG. 4 is a right side view of the trigger assembly shown in FIGS. 2 and 3.
Figure 14:
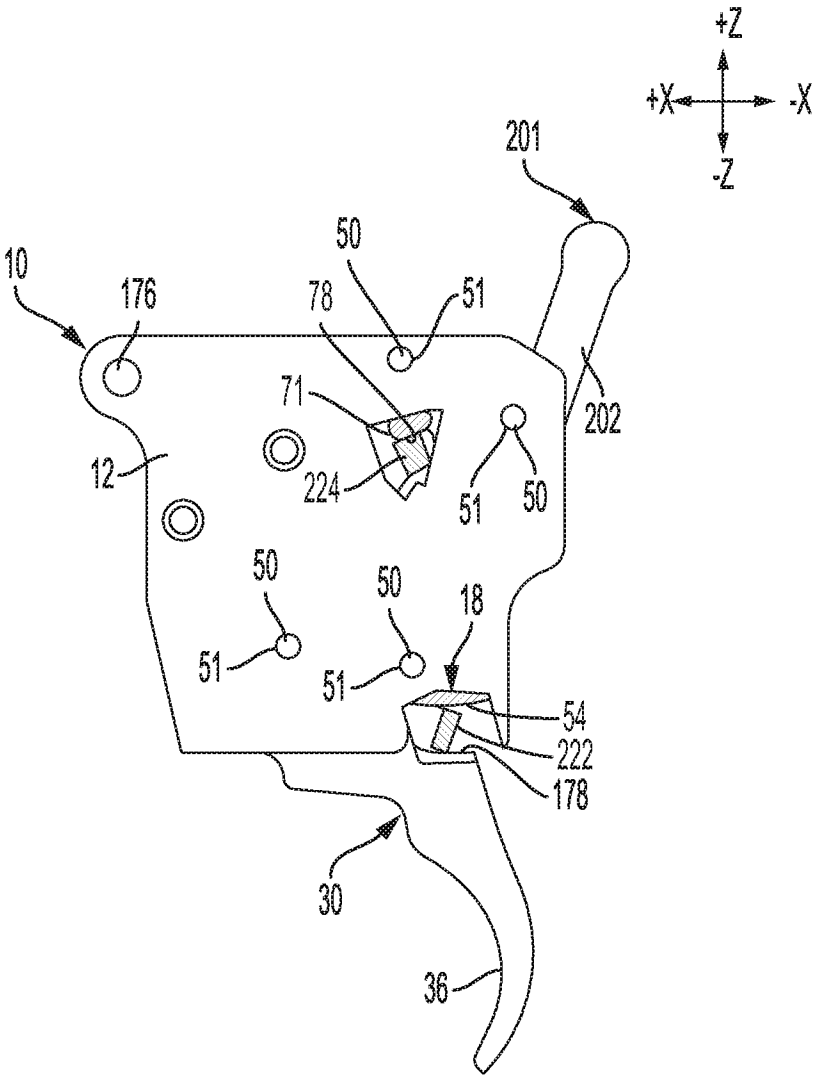
FIG. 14 is a left side view of the trigger assembly shown in FIGS. 2-13, depicting the safety lever in the locked position.

The trigger lever 16 is mounted for rotation on a pin 50, as shown in FIG. 11. A first end portion of the pin 50 is mounted in an aperture 51 formed in the housing 12, as can be seen in FIG. 14. The pin 50 is retained in the aperture 51 by an interference fit; the pin 50 can be retained by other means in alternative embodiments. A second end portion of the pin 50 is disposed in an aperture 49 formed in the cover plate 14, as shown in FIG. 4. The end portions of the pin 50 are narrower than the middle portion of the pin 50; this feature helps the pin 50 to remain captive between the housing 12 and the cover plate 14.

The pin 50 extends through a bore formed in the third portion 34 of the trigger lever 16. The pin 50 and the bore are sized so that minimal clearance is present between the outer surface of the pin 50 and the periphery of the bore. This feature permits the trigger lever 16 to rotate freely on the pin 50, with minimal non-rotational motion.

Figure 26:
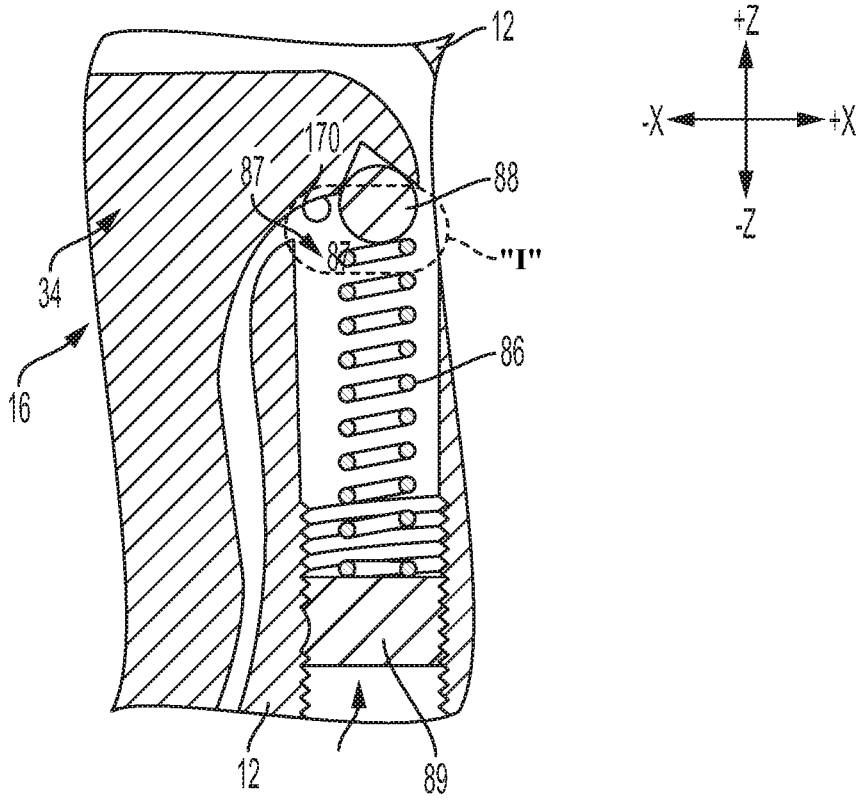
FIG. 26 is a cross-sectional view of the area designated "C" in FIG. 11, taken perpendicular to the "x" and "z" axes.

The trigger lever 16 is biased in a counter-clockwise direction, from the perspective of FIG. 11, by a spring 86. As shown in FIG. 26, the spring 86 is located within a passage 87 formed in the housing 12, below a lower surface 170 of the third portion 34 of the trigger lever 16. The spring 86 acts against the lower surface 170 via a ball 88 positioned between the spring 86 and the lower surface 170. The lower surface 170 is notched as shown in FIG. 26, to accommodate the ball 88.

The non-planar spherical surface of the ball 88 permits the spring 86 to change its orientation to conform to the rotational movement of the trigger lever 16, while maintaining its linear configuration. More specifically, the spherical surface permits the spring 86 to tilt, rather than bend in relation to its axis as the trigger lever 16 rotates. Because the spring 86 does not bend, i.e., because the spring 86 remains square with respect to its axis, the load being applied to the spring 86 by the trigger lever 16 remains a compressive load applied along the axis of the spring 86. As a result, the relationship between deflection and applied force for the spring 86 remains substantially linear as the spring 86 is compressed by the rotating trigger lever 16, and the spring 86 deflects in a smooth and predictable manner. Also, the spring 86 is not susceptible to the buckling that can result from the off-axis loading of a compression spring; such buckling, in extreme cases, can result in drag, binding, and damage to the spring. The upper end of the spring 86 can be positioned against other types of non-planar surfaces, such a curved or conical surface, instead of the spherical surface of the ball 88 in alternative embodiments.

Figure 26A:
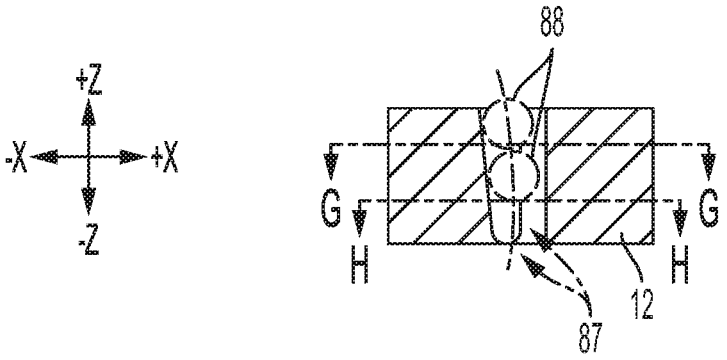
FIG. 26A is a magnified view of the area designated "I" in FIG. 26, depicting movement of a ball through a spring passage in a housing of the trigger assembly show in FIGS. 1-26.
Figure 26B:
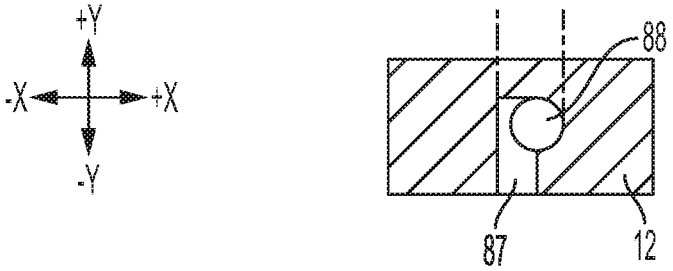
FIG. 26B is a top view of the area designated "I" in FIG. 26.
Figure 26C:
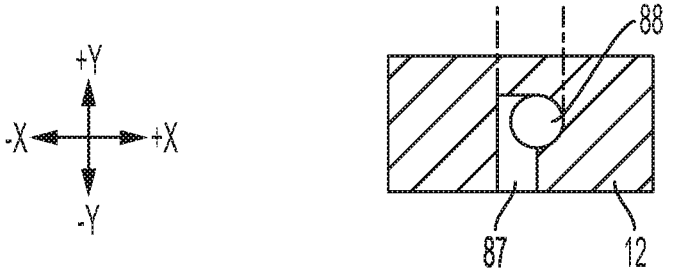
FIG. 26C is a cross-sectional view taken through the line "G-G" of FIG. 26A.
Figure 26D:
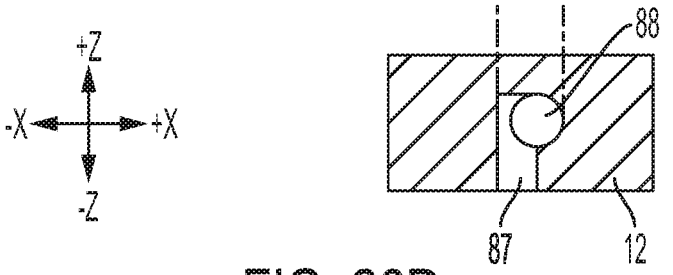
FIG. 26D is a cross-sectional view taken through the line "H-H" of FIG. 26A.

The lateral, or "x," dimension of the passage 87 increases along a portion of the height, or "z" dimension, of the passage 87, so that the passage 87 reaches its maximum lateral dimension proximate the interface between the spring 86 and the trigger lever 16. FIG. 26A depicts the generally downward displacement of the ball 88 as the trigger lever 16 rotates against the bias the spring 86. FIGS. 26B-26D depict the ball 88 in various positions within the passage 87 as the ball 88 is displaced, and depict the change in the lateral dimension of the passage 87. This feature permits the top portion of the spring 86 to translate laterally, in addition to deflecting linearly along its length, as the trigger lever 16 is rotated during actuation of the trigger assembly 10. Permitting the top of the spring 86 to move laterally helps to avoid contact, and the resulting friction, between the spring 86 and the periphery of the passage 87. Permitting the top of the spring 86 to move laterally also helps to avoid off-axis loading of the spring 86, and helps to maintain proper positioning of the ball 88 in relation to the spring 86.

The bottom portion of the passage 87 is threaded, and receives a threaded adjustment screw 89. The adjustment screw 89 supports the lower end of the spring 86. The adjustment screw 89 can be rotated to move the adjustment screw 89 upward or downward in the passage 87, to adjust the degree of compression of the spring 86 and the resulting counter-clockwise bias exerted on the trigger lever 16 by the spring 86. The adjustment screw 89 thereby can facilitate adjustment of the trigger pull weight for the trigger assembly 10.

Figure 27:
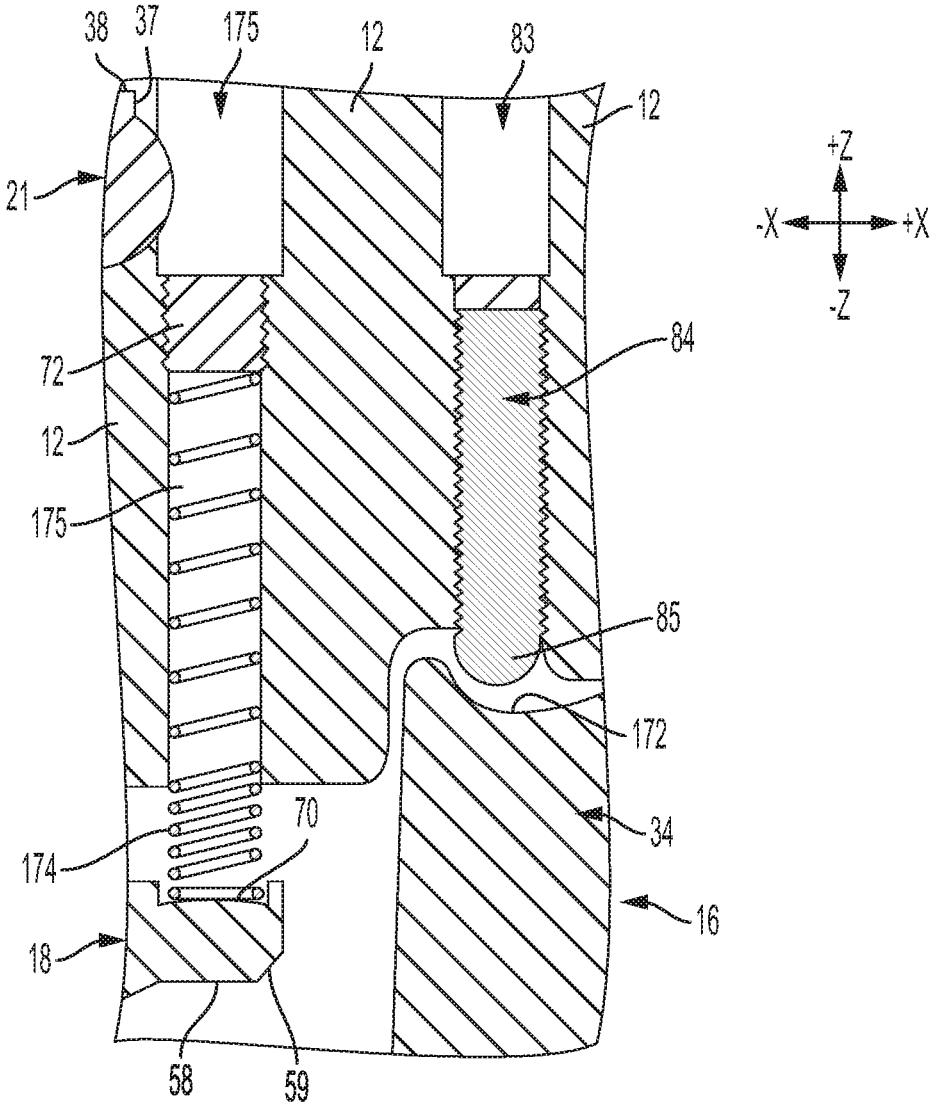
FIG. 27 is a cross-sectional view of the area designated "D" in FIG. 11, taken perpendicular to the "x" and "z" axes.

Referring to FIG. 27, the housing 12 has a partially threaded passage 83 formed therein for receiving a threaded adjustment screw 84. The adjustment screw 84 is positioned so that a lower end 85 of the adjustment screw 84 contacts an upper surface 172 of the third portion 34 of the trigger lever 16 when the trigger lever 16 is rotated away from its rest position. This contact restrains the trigger lever 16 from further counter-clockwise movement. The adjustment screw 84 thus acts as an over-travel stop for the trigger lever 16. The adjustment screw 84 can be rotated within the passage 83 to adjust the vertical, or "z" axis position of the adjustment screw 84. This feature permits the point of contact between the lower end 85 of the adjustment screw 84 and the upper surface 172 to be varied, which in turn varies the degree of rotation that the trigger lever 16 can undergo before being stopped by contact between the lower end 85 of the adjustment screw 84 and the upper surface 172. The adjustment screw 84 thereby facilitates adjustment of the degree of over-travel of the trigger lever 16.

b. Re-Cocking Lever

Figure 8:
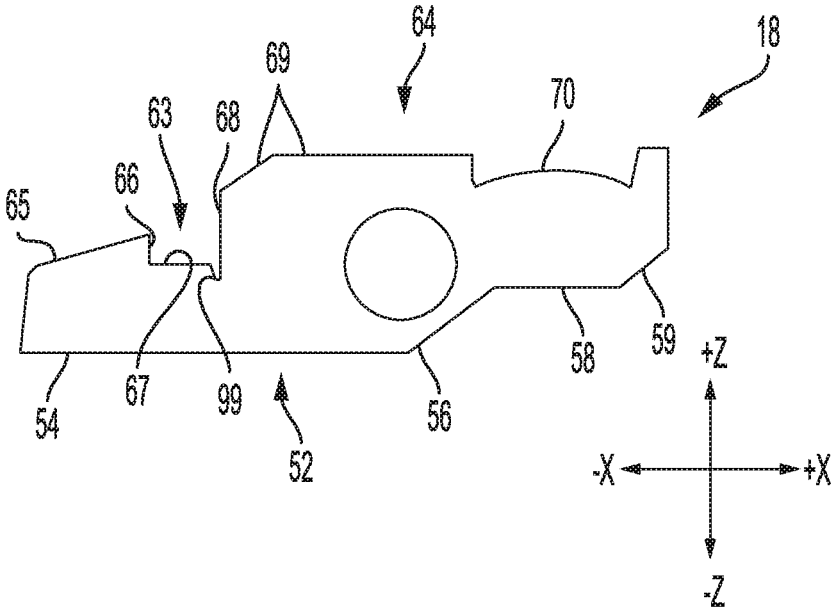
FIG. 8 is a side view of a re-cocking lever of the trigger assembly shown in FIGS. 2-7.

Referring to FIG. 8, the re-cocking lever 18 has a lower surface 52. The lower surface 52 includes a generally flat first portion 54; a generally flat second portion 56 that adjoins the first portion 54; and a generally flat third portion 58 that adjoins the second portion 56. The lower surface 52 also includes a generally flat fourth portion 59 that adjoins the third portion 58 and is oriented at an angle of approximately 45 degrees in relation to the third portion 58; the fourth portion 59 can be oriented at angles other than approximately 45 degrees in alternative embodiments. The upper end 43 of the first adjustment screw 42*a* contacts the third portion 58, and the upper end 43 of the second adjustment screw 42*b* contacts the fourth portion 59 during actuation of the trigger assembly 10.

The re-cocking lever 18 also has an upper surface 64. The upper surface 64 includes a first portion 65; a generally flat second portion 66 that adjoins the first portion 65; and a generally flat third portion 67 that adjoins the second portion 66 and is oriented generally perpendicular to the second portion 66. The upper surface 64 also includes a generally flat fourth portion 68 oriented generally perpendicular to the third 67. The second, third, and fourth portions 66, 67, 68 define a detent 63 in the re-cocking lever 18, the purpose of which is discussed below.

The upper surface 64 also includes a fifth portion 69 that adjoins the fourth portion 68; and a sixth portion 70 that adjoins the fifth portion 69. The sixth portion 70 is cup-shaped; the significance of this feature is discussed below.

The re-cocking lever 18 is mounted for rotation on another pin 50, as shown in FIG. 12. A first end portion of the pin 50 is mounted in another aperture 51 formed in the housing 12, as can be seen in FIG. 1. The pin 50 is retained in the aperture 51 by an interference fit; the pin 50 can be retained by other means in alternative embodiments. A second end portion of the pin 50 is disposed in another aperture 49 formed in the cover plate 14, as shown in FIG. 4. The pin 50 extends through a bore formed in the re-cocking lever 18. The pin 50 and the bore are sized so that minimal clearance is present between the outer surface of the pin 50 and the periphery of the bore.

Figure 21:
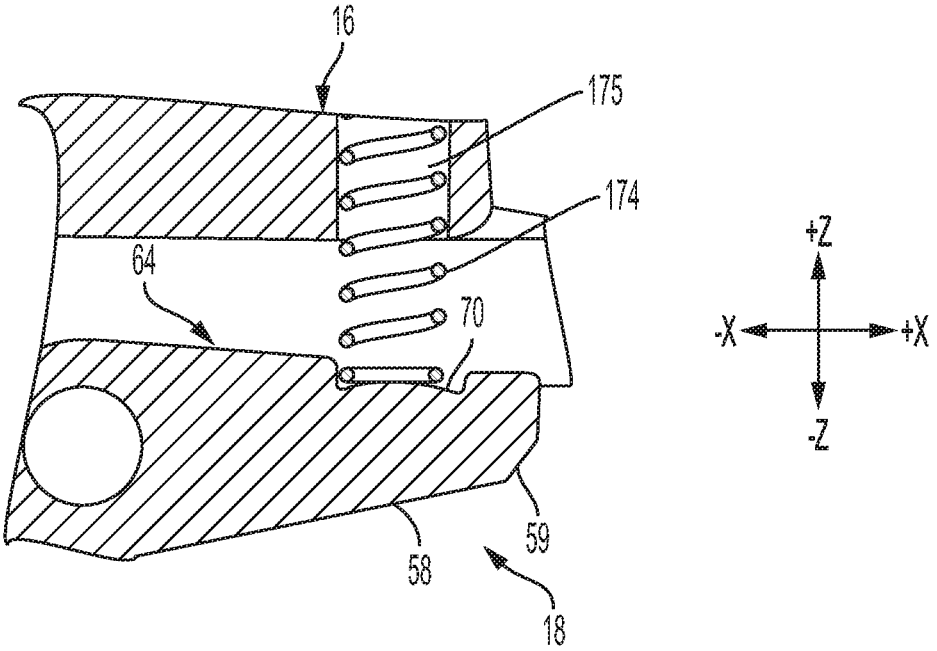
FIG. 21 is a magnified view of the area designated "J" in FIG. 11.
Figure 22:
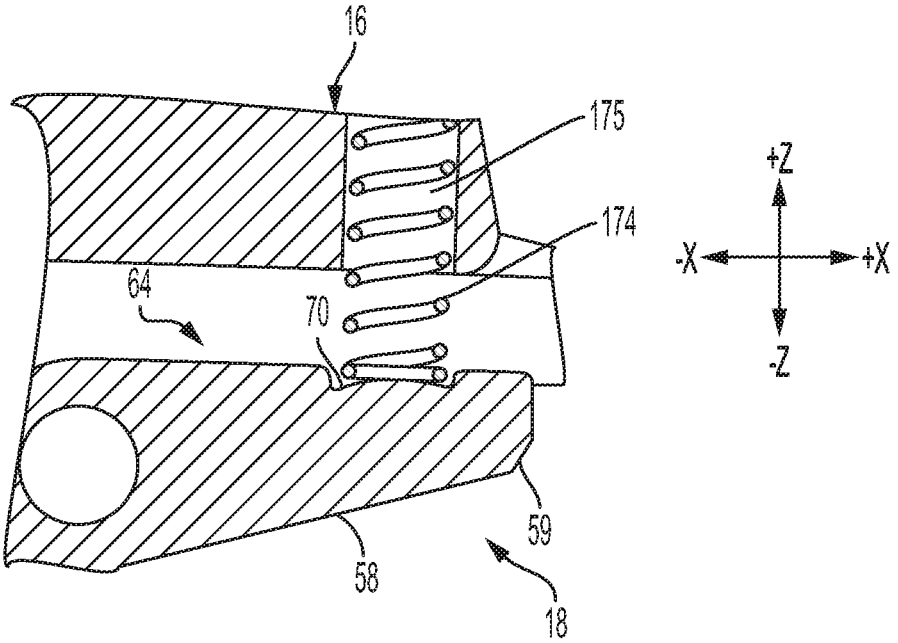
FIG. 22 is a magnified view of the area designated "J" in FIG. 11, after the sear lever of the trigger mechanism has rotated counter-clockwise in relation to the orientation shown in FIG. 21.

The re-cocking lever 18 is biased in a clockwise direction, from the perspective of FIG. 11, by a spring 174. Referring to FIGS. 21, 22, and 27, the spring 174 is located in a passage 175 formed in the housing 12. A lower end of the spring 174 rests on the sixth portion 70 of the upper surface 64 of the re-cocking lever 18. The cup-shaped configuration of the sixth portion 70 limits lateral, i.e., "x" direction, movement of the lower end of the spring 174, and thereby helps to retain the lower end of the spring 174.

The bottom of the sixth portion 70 is outwardly rounded, i.e., convex. The non-planar curved surface of the sixth portion 70 permits the spring 174 to change its orientation to conform to rotational movement of the re-cocking lever 18, while maintaining its linear configuration. This can be seen in FIGS. 21 and 22, which depict the re-cocking lever 18 in two different angular orientations. As discussed above in relation to the spring 86, this feature helps to minimize bending of the spring 174 during rotation of the re-cocking lever 18, so that the spring 174 tilts, rather than bends in relation to its axis as the re-cocking lever 18 rotates. As a result, the spring 174 deflects in a smooth and predictable manner in response to the rotation of the re-cocking lever 18, and the spring 174 is not susceptible the buckling that can result from the off-axis loading of a compression spring. The lower end of the spring 174 can be positioned against other types of non-planar surfaces, such a spherical or conical surface, in alternative embodiments.

The upper portion of the passage 175 is threaded, and receives a threaded adjustment screw 62. The adjustment screw 62 contacts the upper end of the spring 174. The adjustment screw 62 can be rotated to move the adjustment screw 62 upward or downward in the passage 175, to adjust the degree of compression of the spring 174 and the resulting clockwise bias exerted on the re-cocking lever 18 by the spring 174.

c. Sear Lever

Figure 9:
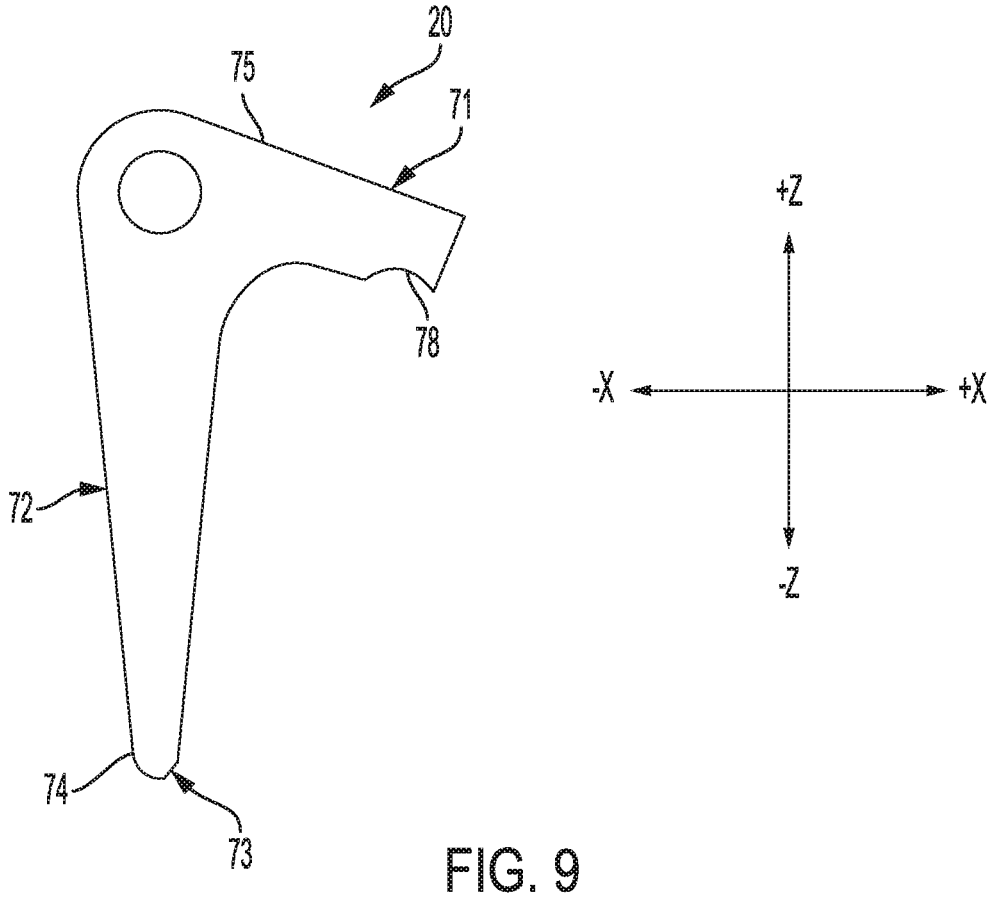
FIG. 9 is a side view of a sear lever of the trigger assembly shown in FIGS. 2-8.

Referring to FIG. 9, the sear lever 20 includes a body 71, and an arm 72 that adjoins, and extends generally downward from the body 71. The body 71 has a generally flat upper surface 75 that contacts the transfer bar 21.

The arm 72 has a freestanding lower end 73. The lower end 73 is undercut, giving the lower end 73 a stepped profile defined in part by a substantially flat contact surface 74 on the lower end 73. The lower end 73 is located within the detent 63 in the re-cocking lever 18, and the contact surface 74 engages the second portion 66 of the upper surface 64 of the re-cocking lever 18 on a selective basis, as discussed in detail below.

Due to the need for the second portion 66 of the upper surface 64 of the re-cocking lever 18 to separate cleanly and reliably from the contact surface 74 of the sear lever 20, the detent 63 in the re-cocking lever 18 includes a channel portion 99, visible in FIG. 8. The channel portion 99 forms a minor volume below the major portion of the detent 63; the minor volume can receive dirt and other contaminants that otherwise could accumulate within the major volume of the detent 63, and interfere with the proper mechanical interaction between the second portion 66 of the upper surface 64 and the contact surface 74.

As can be seen in FIG. 9, the thickness, or "x" dimension of the arm 72 varies along the height, or "z" dimension of the arm 72, with the thickness increasing linearly between the lower end 73, and the portion of the arm 72 that adjoins the body 71. The increase in thickness along the height of the arm 72 can be non-linear in alternative embodiments. The increase in thickness causes the loading on the arm 72 to be distributed over a larger area in comparison to an arm of constant thickness. Distributing the loading over a larger area can help minimize the potential for an overstress condition in the arm 72, and a structural failure of the arm 72 which could result in a potentially deadly unintentional discharge of the rifle 100.

Figure 2:
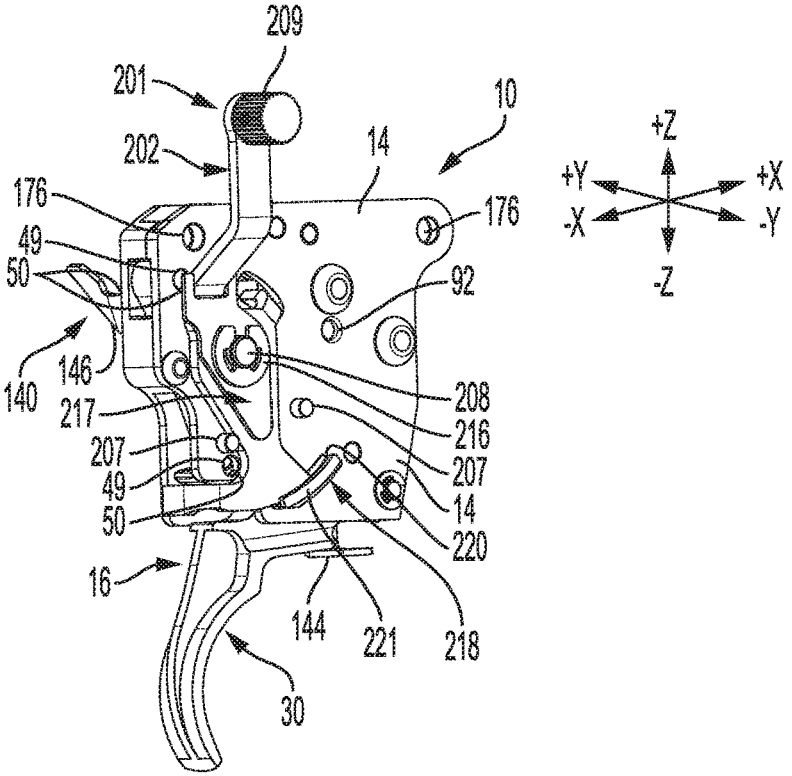
FIG. 2 is a rear perspective view of the trigger assembly of the rifle shown in FIG. 1.

The sear lever 20 is mounted for rotation on another pin 50, as can be seen in FIG. 12. A first end portion of the pin 50 is mounted in another aperture 51 formed in the housing 12, as shown in FIG. 14. The pin 50 is retained in the aperture 51 by an interference fit; the pin 50 can be retained by other means in alternative embodiments. A second end portion of the pin 50 is disposed in another aperture 49 formed in the cover plate 14, as can be seen in FIG. 2. The pin 50 extends through a bore formed in the body 71 of the sear lever 20. The pin 50 and the bore are sized so that minimal clearance is present between the outer surface of the pin 50 and the periphery of the bore.

Figure 28:
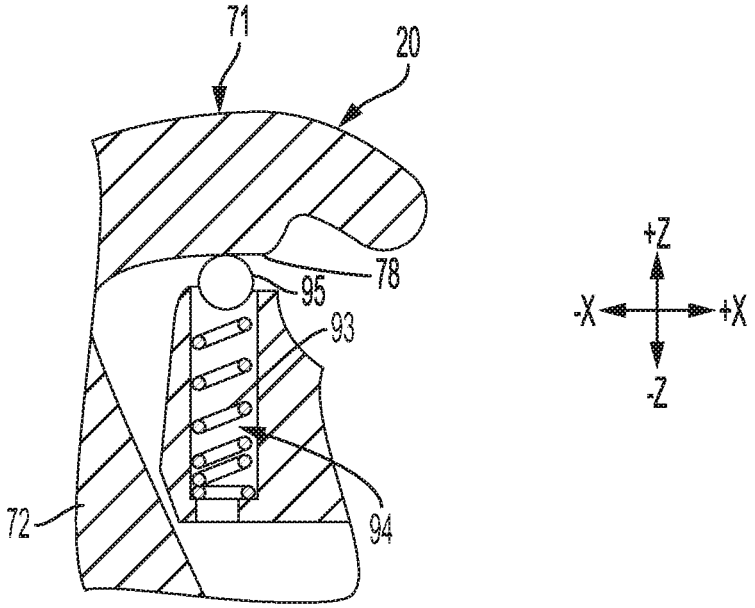
FIG. 28 is a cross-sectional view of the area designated "E" in FIG. 11, taken perpendicular to the "x" and "z" axes.

The sear lever 20 is biased in a counter-clockwise direction, from the perspective of FIG. 11, by a spring 93. Referring to FIG. 28, the spring 93 is located within a passage 94 formed in the housing 12. The spring 93 acts against a lower surface 78 of the body 71 via a ball 95 positioned between the spring 93 and the lower surface 78. The spring 93 acts as a reset spring that returns the sear lever 20 to its rest position, i.e., to the position shown in FIG. 11, following actuation of the trigger assembly 10.

d. Transfer Bar

Figure 10:
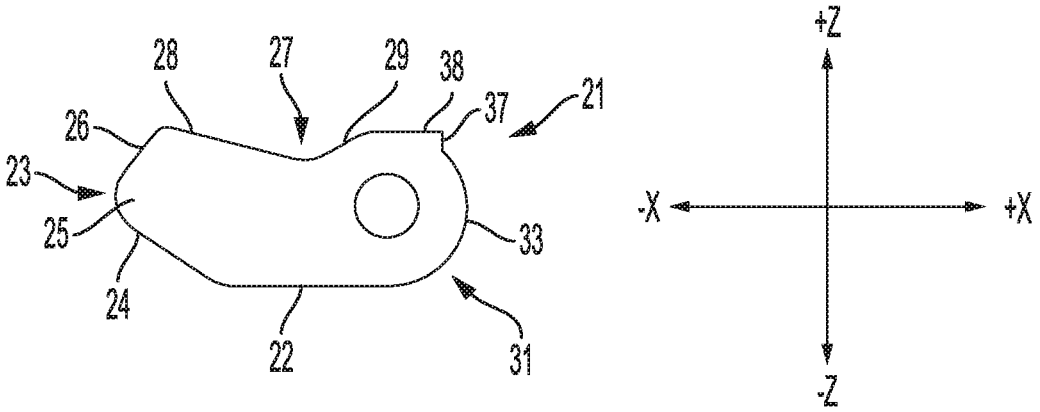
FIG. 10 is a side view of a transfer bar of the trigger assembly shown in FIGS. 2-9.

Referring to FIG. 10, the transfer bar 21 has a generally flat lower surface 22, and a forward surface 23. The forward surface 23 has a generally flat first portion 24 that adjoins the lower surface 22; a curved second portion 25 that adjoins the first portion 24; and a generally flat third portion 26 that adjoins the second portion 25. The transfer bar 21 also includes an upper surface 27 having a generally flat first portion 28 that adjoins the third portion 26 of the forward surface 23; a curved second portion 29 that adjoins the first portion 28; and a generally flat third portion 38 that adjoins the second portion 29. The transfer bar 21 also includes a rear surface 31 having a generally flat first portion 37 that adjoins the third portion 38 of the upper surface 27; and a curved second portion 33 that adjoins the first portion 37, and the lower surface 22.

The transfer bar 21 is mounted for rotation on another pin 50, as can be seen in FIG. 12. A first end portion of the pin 50 is mounted in another aperture 51 formed in the housing 12, as shown in FIG. 14. The pin 50 is retained in the passage 51 by an interference fit; the pin 50 can be retained by other means in alternative embodiments. A second end portion of the pin 50 is disposed in another aperture 49 formed in the cover plate 14, as can be seen in FIG. 4. The pin 50 extends through a bore formed in the transfer bar 21. The pin 50 and the bore are sized so that minimal clearance is present between the outer surface of the pin 50 and the periphery of the bore.

Referring to FIGS. 11 and 12, the transfer bar 21 contacts the sear lever 20, and the cocking piece 112. More specifically, the lower surface 22 of the transfer bar 21 contacts the upper surface 75 of the sear lever 20. The third portion 26 of the forward surface 23 of the transfer bar 21 engages a contact surface 134 on the lip 127 on the cocking piece 112 when the bolt assembly 102 is in its closed position. The contact surface 134 is angled by approximately 27 degrees in relation to the horizontal, i.e., the "x" direction; and the third portion 26 of the forward surface 23 is similarly oriented, so that the overlapping portions of the contact surface 134 and the third portion 26 lie substantially flat against each other.

The contact surface 134 comes into contact with the third portion 26 of the forward surface 23 of the transfer bar 21 as the bolt assembly 102 is moved forward, toward its closed position. The engagement of the contact surface 134 by the forward surface 23 restrains the cocking piece 112 and the attached firing pin 106 from further forward movement. The contact surface 134 and the forward surface 23 remain engaged until the trigger assembly 10 is actuated, at which point the cocking piece 112 and the firing pin 106 are free to move forward under the bias of the spring of the striker 105, toward the unfired cartridge in the barrel chamber of the barrel 130.

Due to the angled orientations of the contact surface 134 and the third portion 26 of the forward surface 23, the cocking piece 112 exerts a force on the transfer bar 21 that acts in the forward and downward directions; and thereby biases the transfer bar 21 in a counter-clockwise direction from the perspective of FIG. 11. The engagement of the contact surface 74 of the arm 72 and the second portion 66 of the upper surface 64 of the re-cocking lever 18 counteracts the torque exerted on the sear lever 20 by the transfer bar 21; this prevents the sear lever 20 from rotating in a clockwise direction, which in turn prevents the transfer bar 21 from disengaging from the cocking piece 112.

The transfer bar 21 is relatively short, spanning less than half the width, or "x" dimension, of the housing 12. As can be seen in FIGS. 11 and 12, the relatively short length of the transfer bar 21 results in unimpeded access to the adjustment screw 84 that facilitates adjustment of the over-travel of the trigger lever 16; and the adjustment screw 62 that facilitates adjustment of the spring bias on the re-cocking lever 18. Conventional transfer bars typically are attached to the housing at the forward-most aperture used to mount trigger assembly to the receiver, and thus span nearly an entire length of the housing. Conventional transfer bars, therefore, typically have openings formed therein to provide external access to adjustment features such as the adjustment screws 84, 62. The presence of access openings in a transfer bar can reduce the mechanical strength of the transfer bar, making the transfer bar susceptible to failure when subjected the vibrations and stresses normally present during operation of a firearm. Thus, configuring the transfer bar 21 to eliminate the need for such openings can be advantageous.

The transfer bar 21 and the housing 12 are configured to provide secondary, i.e., back-up, retention of the transfer bar 21. Secondary retention of the transfer bar 21 can be used, for example, in the event of a mechanical failure or excessive wear of the pin 50 associated with the transfer bar 21, or the transfer bar 21 itself; or some other occurrence under which the primary restraint of the transfer bar 21, i.e., the pin 50, no longer constrains the transfer bar 21 within its intended range of pivoting movement. Such unintended movement of the transfer bar 21 has the potential to result in unintentional actuation of the trigger assembly 10 and an accidental discharge of the rifle 100.

Referring to FIGS. 11 and 12, secondary restraint of the transfer bar 21 is provided by the second portion 33 of the rear surface 31 of the transfer bar 21, and an adjacent surface 160 of the housing 12. The surface 160 has an inward curvature that substantially matches the outward curvature of the second portion 33. Also, the surface 160 is separated from the adjacent portion of the second portion 33 with minimal clearance. Thus, in the event the transfer bar 21 no longer is properly restrained by its associated pin 50, and the transfer bar 21 is loaded due to its engagement with the cocking piece 112 (which potentially is the most dangerous time for uncontrolled movement of the transfer bar 21), the transfer bar 21 will remain immobilized by its adjacent structure. Specifically, the lateral ("x" direction) and downward ("z" direction) loading exerted by the cocking piece 112 on the transfer bar 21 will drive the second portion 33 of the rear surface 31 of the transfer bar 21 into the adjacent surface 160 of the housing 12, while urging the lower surface 22 of the transfer bar 21 into the upper surface 75 of the immobilized sear lever 20. The transfer bar 21 thus is safely held captive by its surrounding structure, unable to release the cocking piece 112, until the trigger assembly 10 is intentionally actuated in the normal manner, i.e., by rotating the trigger lever 16. The surface 160 can have a shape other than curvilinear in alternative embodiments, provided the surface 160 is configured to capture the adjacent structure of the transfer bar 21 as discussed above.

Figure 6:
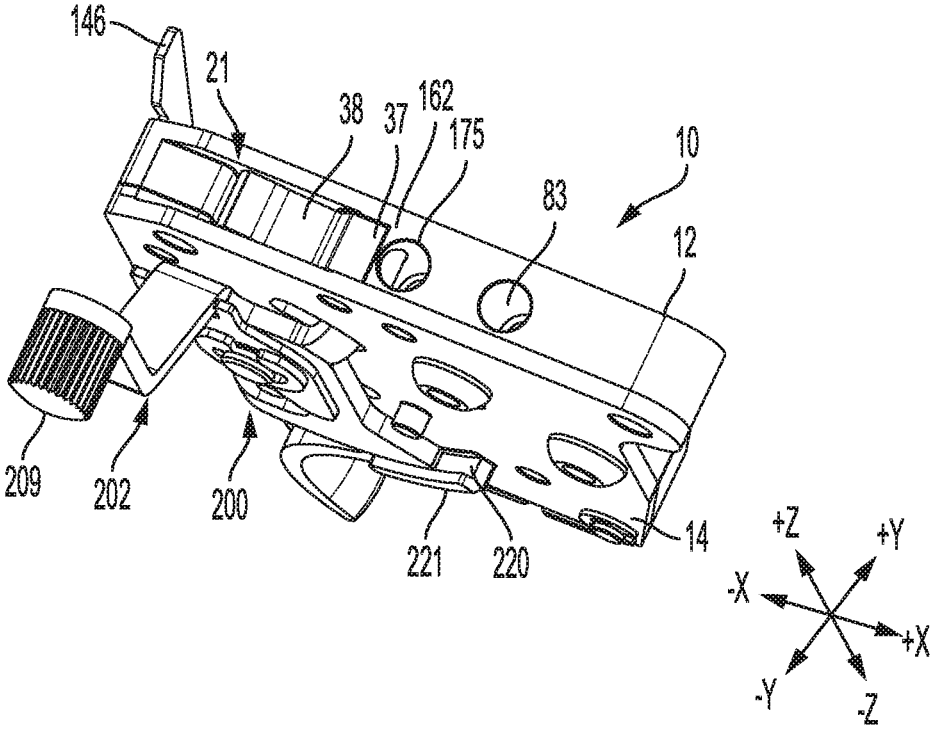
FIG. 6 is a top perspective view of the trigger assembly shown in FIGS. 2-5.

Referring to FIGS. 6, 11, and 12, the first portion 37 of the rear surface 31 of the transfer bar 21 is configured to act as a stop that limits rotation of the transfer bar 21. Specifically, the housing 12 has a surface 162 that adjoins the surface 160, and is adjacent to the first portion 37. The generally flat configuration of the first portion 37 causes the first portion 37 to act as a raised lip that contacts the surface 162 of the housing 12 when the transfer bar 21 rotates in the clockwise direction beyond its rest position shown in FIG. 11. This contact interferes with further clockwise rotation of the transfer bar 21.

Unlike many conventional means for limiting rotational over-travel of a transfer bar, the anti-rotation feature provided by the first portion 37 of the rear surface 31 of the transfer bar 21 and the surface 162 of the housing 12 does not require that the transfer bar 21 be spring biased. Thus, the anti-rotation feature disclosed herein does not present the assembly difficulties associated with maintaining a spring bias on a transfer bar 21 while simultaneously assembling other spring-biased components of the trigger assembly 10.

e. Housing and Cover Plate

Figure 3:
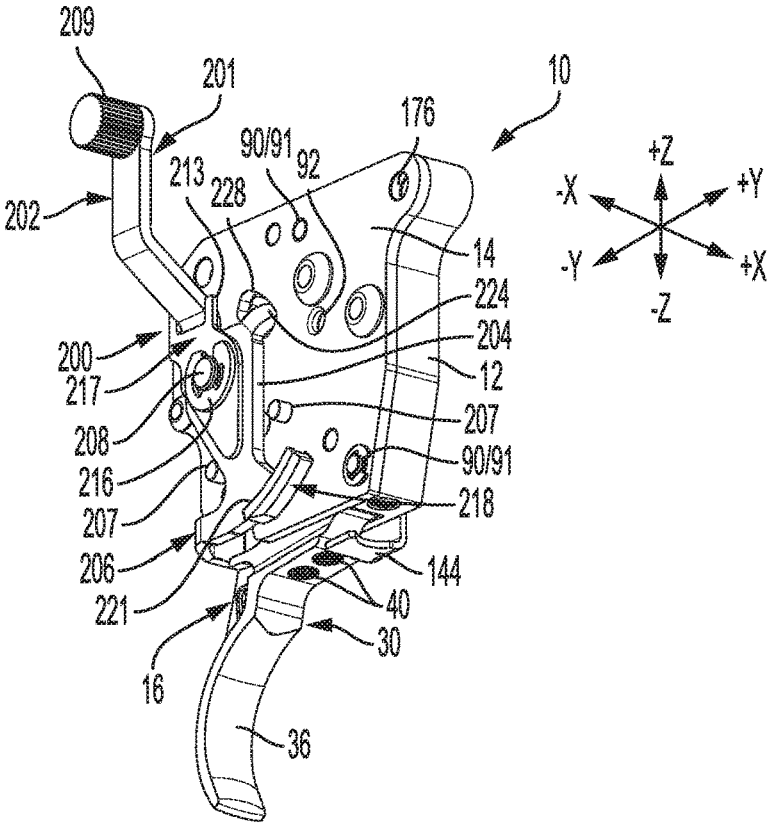
FIG. 3 is a bottom-front perspective view of the trigger assembly shown in FIG. 2.
Figure 29:
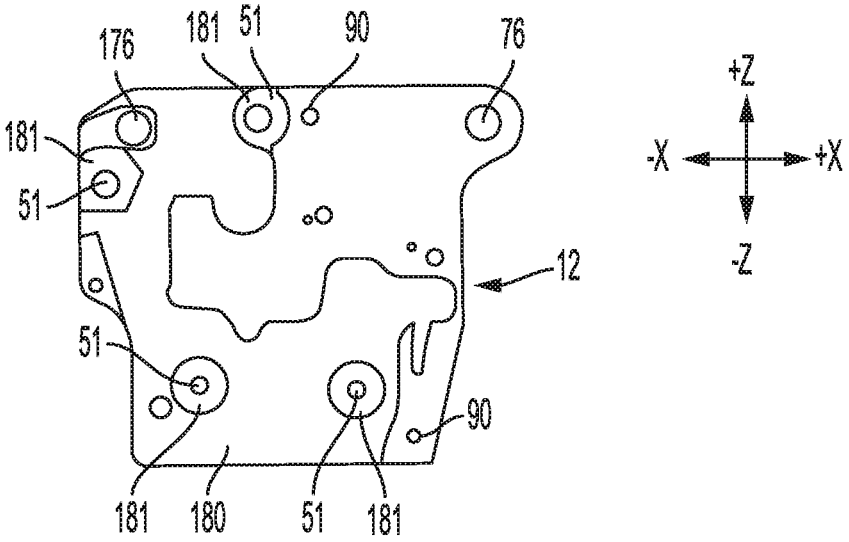
FIG. 29 is depicts an interior surface of a housing of the trigger assembly shown in FIGS. 1-28.
Figure 30:
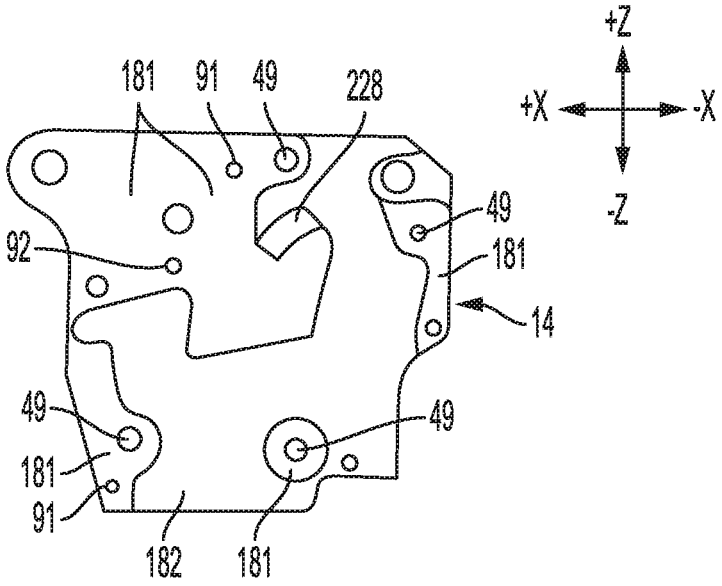
FIG. 30 depicts an interior surface of a cover plate of the trigger assembly shown in FIGS. 1-29.

The housing 12 has two cylindrical alignment posts 90 integrally formed therein, as shown in FIG. 29. The alignment posts 90 are received in apertures 91 formed in the cover plate 14, as can be seen in FIGS. 3 and 30. The alignment posts 90 and the apertures 91 are sized so that no substantial clearance is present between the outer circumferential surface of each alignment post 90 and the adjacent surface of the cover plate 14. The alignment posts 90 resist shear loads that may occur between the housing 12 and the cover plate 14, and thereby help to maintain the housing 12 and the cover plate 14 in a state of alignment. This feature reduces the potential for the pins 50 associated with the trigger lever 16, re-cocking lever 18, sear lever 20, and transfer bar 21 to be subject to the noted shear loads. Subjecting the pins 50 to such loading potentially can impair the ability of the trigger lever 16, re-cocking lever 18, sear lever 20, and transfer bar 21 to rotate freely and smoothly, which in turn can lead to binding and premature wear of the trigger assembly 10, excessive trigger pull weight, rough and uneven trigger pull, and reduced accuracy for the rifle 100.

The alignment posts 90 can be formed separately from the housing 12 in alternative embodiments. In other alternative embodiments, the alignment posts 90 can be formed in the cover plate 14, and the apertures 91 can be formed in the housing 12.

The cover plate 14 is secured to the housing 12 by a plurality of fasteners. The cover plate 14 has an aperture 92 formed therein and depicted in FIGS. 2, 3, and 30. The aperture 92 has an internal thread pattern that matches the external thread pattern on the fasteners. The aperture 92 is aligned with, i.e., is positioned opposite, a relatively thick and solid portion of the housing 12. After the fasteners are removed during disassembly of the trigger assembly 10, one of the fasteners can be screwed into the aperture 92 so that the end of the fastener urges the housing 12 and the cover plate 14 away from each other. This feature thus can assist the user or maintainer in removing the cover plate 14 from the housing 12 without the need to pry the components apart, thereby eliminating the potential for damage to the cover plate 14 and/or the housing 12 which often results from prying.

As noted above, the housing 12 and the cover plate 14 have apertures 51, 49 formed therein that receive the pins 50 upon which the trigger lever 16, re-cocking lever 18, sear lever 20, and transfer bar 21 are mounted. An interior surface 180 of the housing 12 has a raised areas 181 located around the apertures 51 in the housing 12, as shown in FIG. 29. An interior surface 182 of the cover plate 14 likewise has raised areas 181 located around the apertures 49 in the cover plate 14, as shown in FIG. 30.

The raised areas 181 on the housing 12 form the contact areas between the housing 12, and one of the respective sides of the trigger lever 16, re-cocking lever 18, sear lever 20, and transfer bar 21. The raised areas 181 on the cover plate 14 likewise form the contact areas between the cover plate 14, and the other respective sides of the trigger lever 16, re-cocking lever 18, sear lever 20, and transfer bar 21. The raised areas 181 on the housing 12 minimize the contact area between the housing 12, and the trigger lever 16, re-cocking lever 18, sear lever 20, and transfer bar 21. The raised areas 181 on the cover plate 14 likewise minimize the contact area between the cover plate 14, and the trigger lever 16, re-cocking lever 18, sear lever 20, and transfer bar 21. The raised areas 181 thereby can reduce friction resulting from the rotation of the trigger lever 16, re-cocking lever 18, sear lever 20, and transfer bar 21 in relation to the housing 12 and cover plate 14; and can lower the potential for binding of the trigger lever 16, re-cocking lever 18, sear lever 20, and transfer bar 21. The raised areas 181 can be formed on the sides of the trigger lever 16, re-cocking lever 18, sear lever 20, and transfer bar 21 instead of, or in addition to the interior surface 180 the housing 12 and the interior surface 182 of the cover plate 14.

Figure 23:
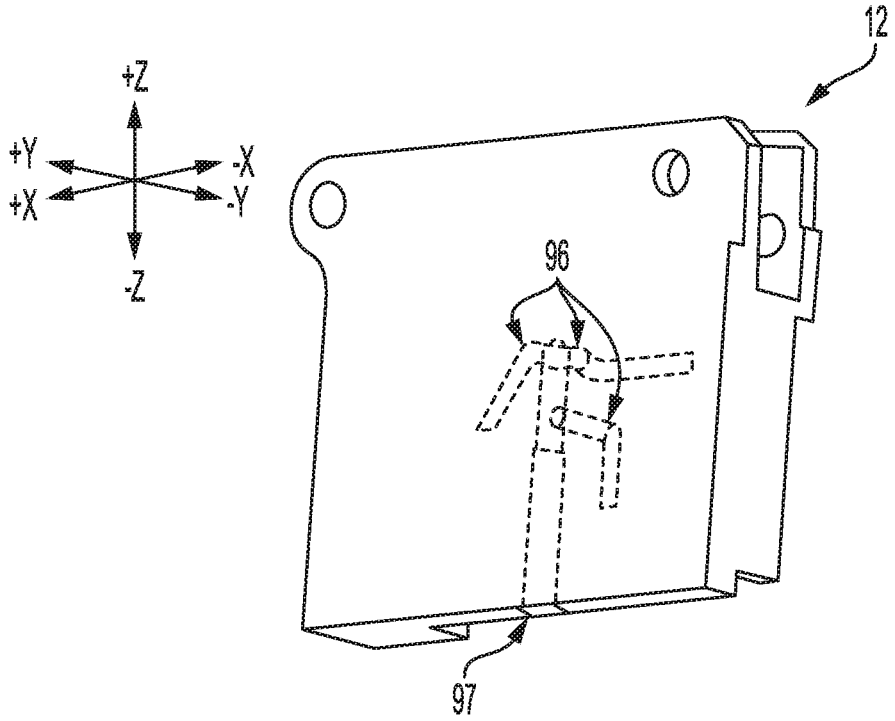
FIG. 23 is a left-bottom perspective view of a housing of the trigger mechanism shown in FIGS. 1-22.
Figure 24:
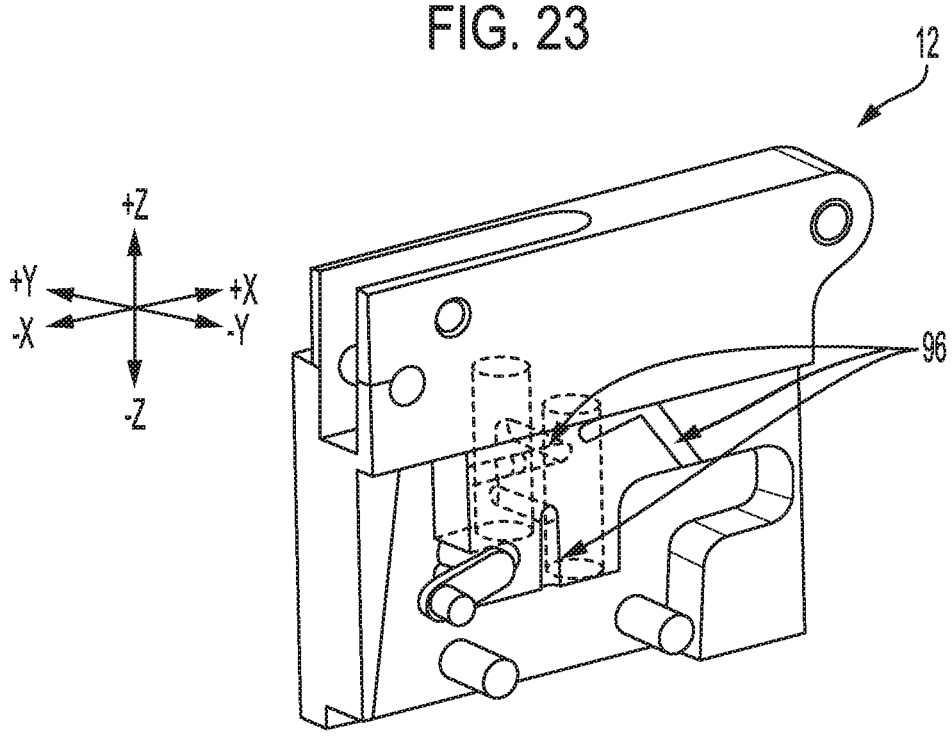
FIG. 24 is a right-top perspective view of the housing of the trigger mechanism shown in FIGS. 1-23.

Referring to FIGS. 23 and 24, the housing 12 has internal passages 96 formed therein to facilitate the distribution of cleaning fluid and compressed air throughout the interior of the trigger assembly 10. The passages 96 are in fluid communication with a port 97 located on the bottom of the housing 12. The port 97 can receive a tube or other means for introducing the cleaning fluid or compressed air into the passages 96. The passages 96 extend to locations within the housing 12 that allow the cleaning fluid and compressed air to reach, for example, the respective pivot points for the trigger lever 16, re-cocking lever 18, sear lever 20, and transfer bar 21; other areas on the trigger lever 16, re-cocking lever 18, sear lever 20, and transfer bar 21 that contact the housing 12 and the cover plate 14; and the areas on the trigger lever 16, re-cocking lever 18, sear lever 20, and transfer bar 21 that contact each other.

The ability to introduce cleaning fluid and compressed air to various locations within the trigger assembly 10 without the need to disassemble the trigger assembly 10 can reduce the time and effort needed to clean the trigger assembly 10; can lead to more frequent cleaning of the trigger assembly 10; and can make it possible to clean the trigger assembly 10 under field conditions where cleaning otherwise would not be feasible.

Actuation of the Trigger Mechanism

Actuation of the trigger assembly 10 initiates the firing sequence for the rifle 100. FIG. 11 depicts the various components of the trigger assembly 10 in their respective rest positions, prior to actuation of the trigger assembly 10. FIG. 12 shows the components their respective positions immediately after actuation.

The user actuates the trigger assembly 10 by exerting a rearward force on the surface 36 of the first portion 30 of the trigger lever 16, causing the trigger lever 16 to rotate in a clockwise direction from the perspective of FIG. 11. The rotation of the trigger lever 16 causes the upper surface 47 of the second portion 32 of the trigger lever 16 to move in a generally upward direction, toward the first, second, third, and fourth portions 54, 56, 58, 59 of the lower surface 52 of the re-cocking lever 18.

The trigger lever 16 imparts rotation to the re-cocking lever 18 by way of the first and second adjustment screws 42*a*, 42*b*. As discussed above, the extent to which the upper ends 43 of the first and second adjustment screws 42*a*, 42*b* project above the upper surface 47 of the second portion 32 of the trigger lever 16 can be adjusted by turning the first and second adjustment screws 42*a*, 42*b* within their respective passages 40.

The positions of the upper ends 43 of the first and second adjustment screws 42*a*, 42*b* in relation to the upper surface 47 of the second portion 32 can be adjusted to vary the characteristics of the trigger pull for the trigger assembly 10. More specifically, the upper ends 43 can be positioned to produce a single-stage trigger pull in which the trigger pull weight remains substantially constant throughout the trigger pull. The upper ends 43 also can be positioned to produce a two-stage trigger pull in which the trigger pull weight abruptly increases at some point in the trigger pull. The point in the trigger pull at which the change in trigger pull weight occurs, and the magnitude of the change, can be adjusted by varying the positions of the upper ends 43.

FIGS. 11 and 12 depict the first and second adjustment screws 42*a*, 42*b* configured to produce a two-stage trigger pull. FIG. 11 shows the trigger assembly 10 prior to rotation of the trigger lever 16, with the various movable components of the trigger member 10 in their respective rest positions. The second adjustment screw 42*b* is positioned so that the upper end 43 of the second adjustment screw 42*b* is in contact with the fourth portion 59 of the lower surface 52 of the re-cocking lever 18. The first adjustment screw 42*a* is positioned so that the upper end 43 of the first adjustment screw 42*a* is spaced apart from the first portion 54 of the lower surface 52. Thus, the initial rotation of the trigger member 16 causes the second adjustment screw 42*b* to impart counter-clockwise rotation to the re-cocking lever 18, against the bias of the spring 174, by way of the fourth portion 59 of the lower surface 52.

The fourth portion 59 of the lower surface 52 is angled to approximately match the curvature of the contacting surface of the rounded upper end 43 of the second adjustment screw 42*b*, as shown in FIG. 11. The fourth portion 59 therefore can slide over the contacting surface of the upper end 43 as the fourth portion 59 and the upper end 43 pivot in different arcs about the respective rotational axes of the re-cocking lever 18 and the trigger lever 16. This relative motion constitutes a camming action that results in a smooth feel to the user as the user pulls the trigger lever 16 through the first stage of the trigger pull. Also, the noted interface between the two contacting surfaces prevents the trigger lever 16 and the re-cocking lever 18 from jamming against each other and locking the trigger assembly 10.

Because the first adjustment screw 42*a* is located farther from the axis of rotation of the trigger lever 16 than the second adjustment screw 42*b*, the counter-clockwise rotation of the trigger lever 16 eventually brings the upper end 43 of the first adjustment screw 42*a* into contact with the first portion 54 of the lower surface 52 of the re-cocking lever 18, as shown in FIG. 12. Continued rotation of the trigger lever 16 after this point causes the first adjustment screw 42*a* to impart counter-clockwise rotation to the re-cocking lever 18; and causes the second adjustment screw 42*b* to come out of contact with the fourth portion 59 of the lower surface 52.

The location at which the first adjustment screw 42*a* applies force to the re-cocking lever 18 is located closer to the axis of rotation of the re-cocking lever 18 than the point at which second adjustment screw 42*b* applies force, i.e., the moment arm through which the first adjustment screw 42*a* applies force to the re-cocking lever 18 is shorter than the moment arm through which the second adjustment screw 42*b* applies its force. The user, therefore, feels an abrupt increase in the trigger pull weight as the first adjustment screw 42*a* begins applying force, and the second adjustment screw 42*b* ceases applying force to the re-cocking lever 18. This point marks the end of the first stage, and the beginning of the second stage of the trigger pull.

Continued clockwise rotation of the trigger lever 16 through the second stage of the trigger pull causes the re-cocking lever 18 to rotate further in the counter-clockwise direction, which in turn decreases the degree of overlap between the second portion 66 of the upper surface 64 of the re-cocking lever 18, and the contact surface 74 of the sear lever 20. As discussed above, the second portion 66 of the upper surface 64 acts as a lip that restrains the sear lever 20 from clockwise rotation, which in turn prevents the transfer bar 21 from rotating to release the cocking piece 112.

The rotation of the re-cocking lever 18 eventually eliminates the overlap between the second portion 66 of the upper surface 64 and the contact surface 74. At this point, the sear lever 20 is free to rotate in the clockwise direction, and no longer restrains the transfer bar 21, as can be seen in FIG. 12. The transfer bar 21 thereby becomes free to rotate in the counter-clockwise direction, in response to the force exerted on the transfer bar 21 by the cocking piece 112 through the angled contact surface 134 of the cocking piece 112 and the similarly-angled the third portion 26 of the forward surface 23 of the transfer bar 21. The rotation of the transfer bar 21 causes the third portion 26 of the forward surface 23, which had been restraining the cocking piece 112 from forward movement, to move out of contact with the contact surface 134. The cocking piece 112, and the attached firing pin 106, are then free to move forward under the bias of the spring of the striker 105. As discussed above, the firing pin 106 subsequently strikes the primer of the unfired cartridge in the barrel chamber of the barrel 130 to initiate the discharge of the rifle 100.

The point in the trigger pull at which the transition from the first to the second stage occurs can be varied by adjusting the positions of the first and second adjustment screws 42*a*, 42*b* within their respective passages 40. The transition can be made to occur earlier in the trigger pull by lowering the second adjustment screw 42*b* in its passage 40, to reduce the distance by which the upper end 43 of the second adjustment screw 42*b* protrudes from the upper surface 47 of the second portion 32 of the trigger lever 16, and/or by raising the first adjustment screw 42*a* in its passage 40 to increase the distance by which the upper end 43 of the first adjustment screw 42*a* protrudes from the upper surface 47. Conversely, the transition can be made to occur later in the trigger pull by raising the second adjustment screw 42*b* in its passage 40, and/or lowering the first adjustment screw 42*a* in its passage 40.

The trigger pull weights during the first and second stages of the trigger pull can be adjusted by increasing or decreasing the tension in the spring 86 that biases the trigger lever 16, and the spring 174 that biases the re-cocking lever 18. This two-point adjustment facilitates adjustment of both the relative, and absolute values of the trigger pull weights associated with the first and second stages.

The trigger assembly 10 can be configured to produce a single-stage trigger pull, i.e., a trigger pull in which the trigger pull weight remains substantially constant throughout the trigger pull. This can be accomplished by raising the first adjustment screw 42*a* in its passage 40, and/or lowering the second adjustment screw 42*b* in its passage 40 so that the second adjustment screw 42*b* does not contact the re-cocking lever 18 at any point in the trigger pull. Thus, the trigger assembly 10 can be reconfigured between a single-stage and two-stage trigger pull quickly and easily by the user, without a need to remove, replace, or modify any components of the trigger assembly 10, and without removing the trigger assembly 10 from the rifle 100.

Following discharge of the cartridge, the user can decrease or remove finger pressure on the surface 36 of the trigger lever 16. This will allow the trigger assembly 10 to reset to the state shown in FIG. 11, as follows: the re-cocking lever 18 will rotate in a clockwise direction under the bias of the spring 174, to its rest position; the sear lever 20 will rotate in a counter-clockwise direction under the bias of the spring 93, to its rest position; the transfer bar 21 will rotate in a clockwise direction in response the counter-clockwise rotation of the sear lever 20, to its rest position; and the trigger lever 16 will rotate in a counter-clockwise direction under the bias of the spring 86, to its rest position. Also, as can be seen in FIG. 11, the lower end 73 of the arm 72 of the sear lever 20 will return to its position within the detent 63.

Interaction Between Trigger Lever and Re-Cocking Lever

As noted above, increasing the degree of overlap between the various contacting surfaces within a trigger assembly such as the trigger assembly 10 can lower the potential for an accidental discharge of the rifle 100. The increased overlap, however, can increase the trigger pull distance and the trigger pull weight, and can make the trigger pull rough and uneven. The trigger assembly 10 can be configured to maximize the distance through which the re-cocking lever 18 rotates in response to the rotation of the trigger lever 16, thereby allowing greater overlap between the contact surface 74 of the sear lever 20, and the second portion 66 of the upper surface 64 of the re-cocking lever 18; without substantially increasing the trigger pull distance or the trigger pull weight, and without making the trigger pull rough or uneven.

Figure 19:
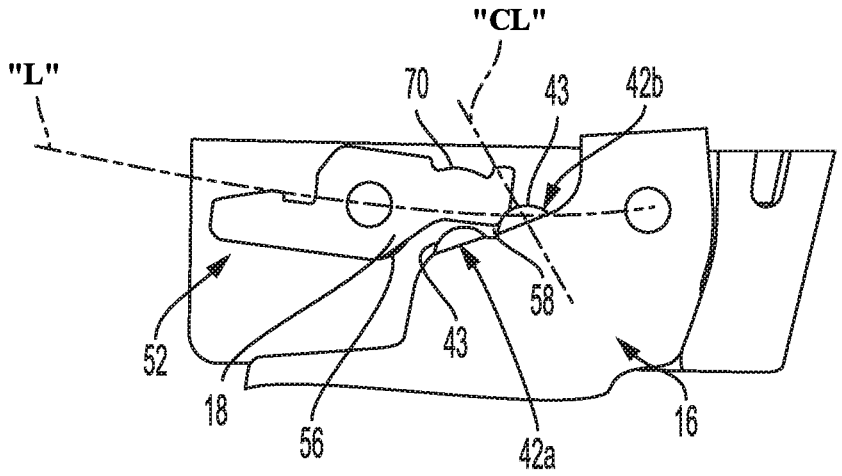
FIG. 19 depicts the trigger lever and the re-cocking lever of the trigger mechanism shown in FIGS. 1-18, at the start of a first stage of a trigger pull of the trigger mechanism.
Figure 20:
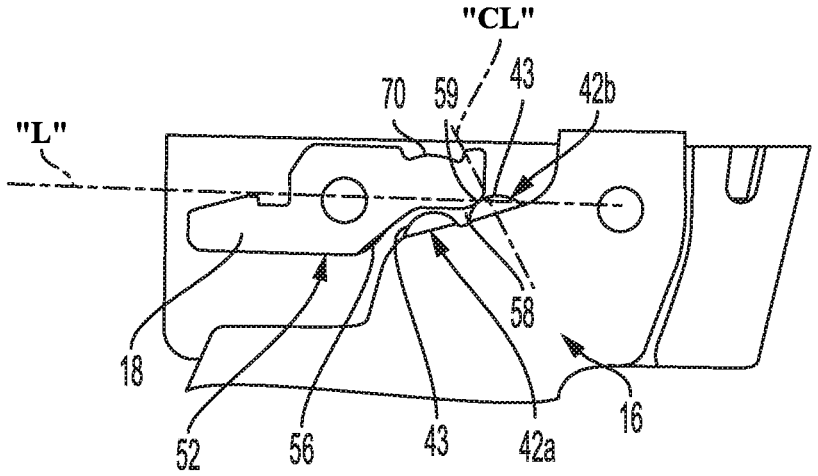
FIG. 20 depicts the trigger lever and the re-cocking lever of the trigger mechanism shown in FIGS. 1-19, at the start of a second stage of the trigger pull.

FIGS. 19 and 20 respectively depict the re-cocking lever 18 and the trigger lever 16 at the start and end of the first stage of the trigger pull. As can be seen in FIG. 19, the re-cocking lever 18 is configured so that its point of contact with the upper end 43 of the second adjustment screw 42*b* is located short of the centerline "CL" of the second adjustment screw 42*b*. FIG. 19 also shows the second adjustment screw 42*b* positioned so that the lengthwise axis "L" of the re-cocking lever 18 is tilted downward, with the point of contact between the re-cocking lever 18 and the upper end 43 of the second adjustment screw 42*b* being lower than the respective axes of rotation of the trigger lever 16 and the re-cocking lever 18. In addition, FIG. 20 shows the first adjustment screw 42*a* positioned so as to come into contact with the re-cocking lever 18 when the lengthwise axis "L" of the re-cocking lever 18 has rotated to an approximately level orientation.

As a result of the above arrangement, and the previously-noted camming action between the contacting surfaces of the re-cocking lever 18 and the second adjustment screw

42*b*, the point of contact between the re-cocking lever 18 and the second adjustment screw 42*b* rides down the surface of the upper end 43 of the second adjustment screw 42*b*, and down the fourth portion 59 of the lower surface 52 of the re-cocking lever 18 as the trigger lever 16 and the re-cocking lever 18 rotate in opposite directions about their respective axes. This causes the distance between the point of contact and the axis of rotation of the re-cocking lever 18 to decrease. This decrease in the moment arm through which force is being applied to the re-cocking lever 18 by the trigger lever 16 in turn causes an increase in the ratio of the angular displacement of the re-cocking lever 18 to the angular displacement of the trigger lever 16 through the first stage of the trigger pull.

As a result of the decreasing moment arm, the re-cocking lever 18 undergoes a larger angular displacement than it otherwise would have experienced during the first stage of the trigger pull. The increased angular displacement of the re-cocking lever 18, in turn, allows a greater degree of overlap between the second portion 66 of the upper surface 64, and the contact surface 74 of the sear lever 20 without increasing the trigger pull distance, which in turn decreases the potential for an unintentional actuation of the trigger assembly 10 and an accidental discharge of the rifle 100.

Safety Mechanism

The trigger assembly 10 also comprises a safety mechanism 200 comprising a safety lever 201 mounted on the exterior of the housing 12. A substantial entirety of the safety mechanism 200 is located external to the housing 12 and the cover plate 14, giving the trigger assembly 10 a more compact overall footprint that a comparable trigger mechanism having a safety mechanism located partly or entirely within the trigger mechanism.

Referring to FIGS. 13-16, the safety lever 201 has a first, or upper portion 202; a second, or middle portion 204 that adjoins the upper portion 202; and a third, or lower portion 206 that adjoins the middle portion 204. The safety lever 201 is mounted for rotation on the cover plate 14 by way of a projection 208 on the cover plate 14. The middle portion 204 has an aperture formed therein that receives the projection 208. The safety lever 201 is retained on the projection 208 by a retaining tab 216 that securely engages the projection 208 by way of a groove (not shown) in the projection 208.

Figure 13:
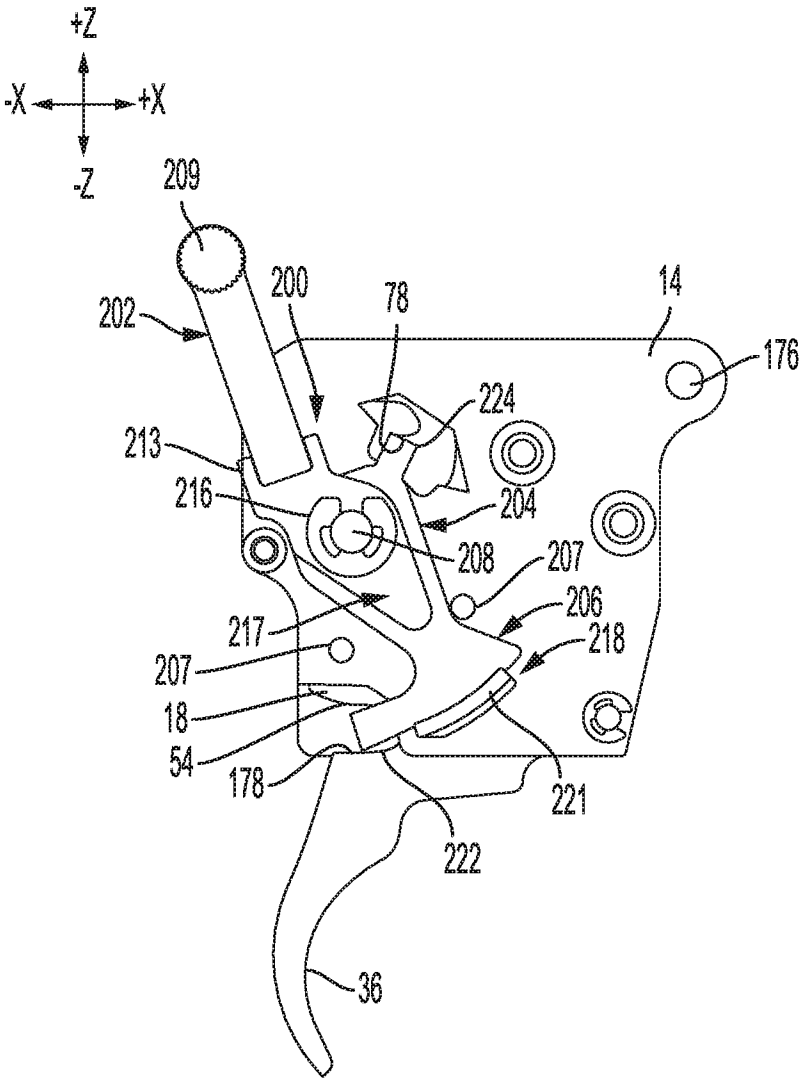
FIG. 13 is a right side view of the trigger assembly shown in FIGS. 2-12, depicting a safety lever of a safety mechanism of the trigger assembly in a locked position.
Figure 16:
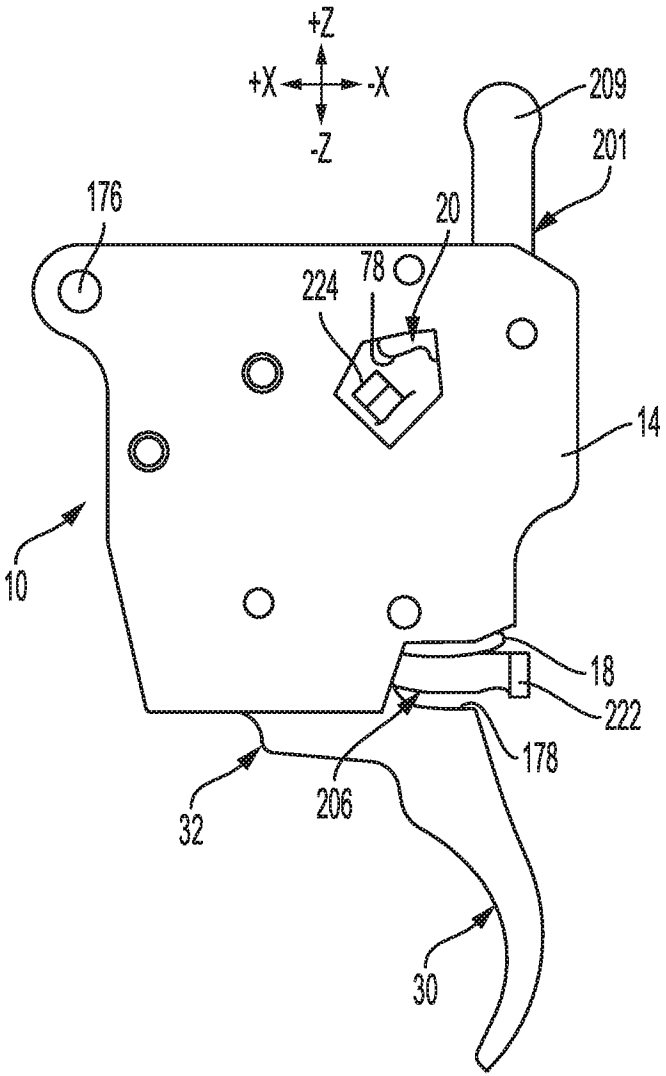
FIG. 16 is a left side view of the trigger assembly shown in FIGS. 2-15, depicting the safety lever in the unlocked position.
Figure 15:
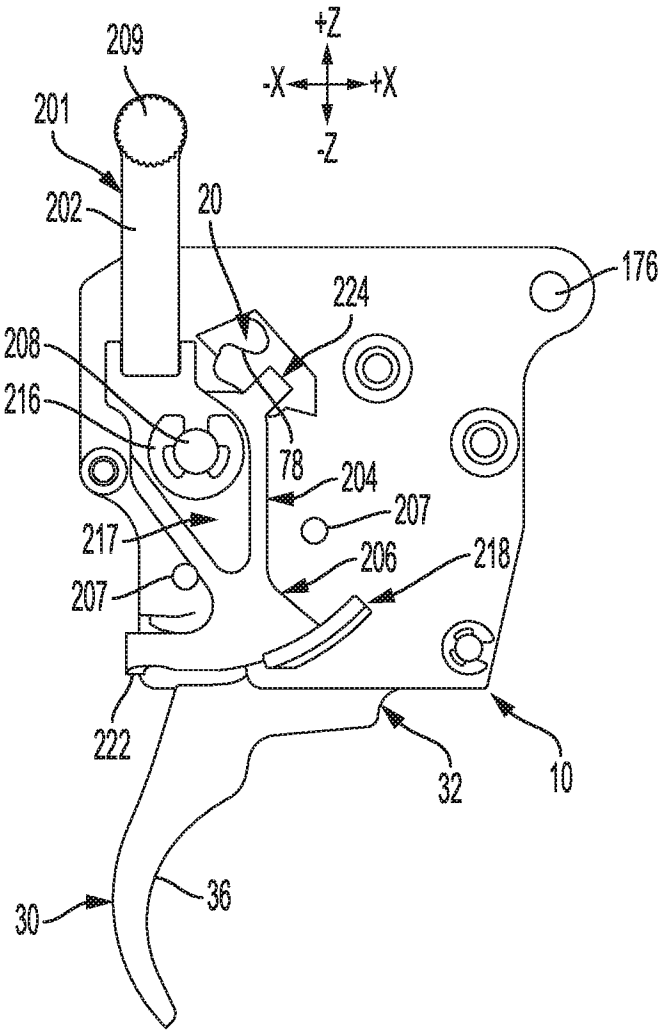
FIG. 15 is a right side view of the trigger assembly shown in FIGS. 2-14, depicting the safety lever in an unlocked position.

The safety lever 201 is movable between a first, or locked position shown in FIGS. 13 and 14; and a second, or unlocked position depicted in FIGS. 15 and 16. Two projections 207 are formed on the exterior surface of the cover plate 14. A first of the projections 207 engages a first side of the middle portion 204 of the safety lever 201 when the safety lever 201 reaches its locked position. A second of the projections 207 engages the opposite side of the middle portion 204 when the safety lever 201 reaches its unlocked position. The projections 207 thus acts as stops for the safety lever 201.

The upper portion 202 has a knob 209 located at the end thereof. The user can exert pressure on the knob 209 to move the safety lever 201 between its locked and unlocked positions.

The safety mechanism 200 also includes a tab 217, visible in FIGS. 13 and 15. The tab 217 is mounted on the projection 208 of the cover plate 14, between the middle portion 204 of the safety lever 201 and the retaining tab 216, by way of an aperture formed in the tab 217. The tab 217 has two arms 213 located on opposite sides of the upper portion 202 of the safety lever 201. The arms 213 engage the safety lever 201, so that the tab 217 rotates with the safety lever 201. The tab 217 covers and retains a ball (not shown) disposed in an aperture formed in the middle portion 204 of the safety lever 201. The ball is carried by the middle portion, and partially engages, i.e., remains slightly short of being completely nested in, a first detent (not shown) formed in the cover plate 14, when the safety lever 201 is in its locked position. The ball partially engages a second detent (not shown) formed in the cover plate 14, when the safety lever 201 is in its unlocked position. The partial engagement of the ball and the first detent retains the safety lever 201 in its locked position, and biases the safety lever 201 toward the locked position. The partial engagement of the ball and the second detent likewise retains the safety lever 201 in its unlocked position, and biases the safety lever 201 toward the unlocked position.

The cover plate 14 includes a curvilinear retaining element or guide 218. The guide 218 is integrally formed with the remainder of the cover plate 14. The guide 218 can be formed separately from the rest of the cover plate 14, and can be fastened to the cover plate 14 in alternative embodiments.

The guide 218 includes an inner surface 220, and a lip 221 that extends from the surface 220. The inner surface 220 is visible in FIGS. 2 and 6. An outer edge of the lower portion 206 of the safety lever 201 contacts, and is held captive by the surface 220 and the lip 221 as the safety lever 201 moves between its locked and unlocked positions. This contact discourages wobble, shimmy, and other unwanted deflection of the safety lever 201 as the safety lever 201 is rotated. The guide 218 thereby can help to ensure full and positive engagement of the safety lever 201 in its locked and unlocked positions; can reduce wear on the safety lever 201 and the projection 208; can reduce the noise generated by the movement of the safety lever 201; and can provide a smoother feel to the user as the user moves the safety lever 201.

The safety mechanism 200, when in its locked position, interferes with the movement of three different components of the trigger assembly 10, each which must move to initiate the firing sequence for the rifle 10. The safely lever 201 thus provides three independent points of interference with the firing sequence.

Referring to FIGS. 13-16, the lower portion 206 of the safety lever 201 includes an interfering member in the form of a tab 222. The tab 222 is oriented substantially perpendicular to the remainder of the lower portion 206. The safety lever 201 is configured so that the tab 222 becomes positioned directly above, and in close proximity to an upper surface 178 of the first portion 30 of the trigger lever 16 when the safety lever 201 is moved to its locked position, as shown in FIGS. 13 and 14. In addition, the tab 222 is positioned directly below, and in close proximity to the first portion 54 of the lower surface 52 of the re-cocking lever 18 when the safety lever 201 is in its locked position, as can also be seen in FIGS. 13 and 14.

The tab 222 thus interferes both with clockwise rotation of the trigger lever 16, and counter-clockwise rotation of the re-cocking lever 18, from the perspective of FIG. 11, when the safety lever 201 is in its locked position. As discussed above, the trigger lever 16 must rotate clockwise, and the re-cocking lever 18 must rotate counter-clockwise in order for the trigger assembly 10 to release the cocking piece 112 and initiate the firing sequence of the rifle 100. The safety lever 201, by preventing such rotation to occur in any substantial amount, thus inhibits initiation of the firing sequence at two separate points within the linkage of the trigger assembly 10. These firing restrictions can be removed by moving the safety lever 201 to the unlocked position shown in FIGS. 15 and 16, which causes the tab 222 to move generally rearward, and out of close proximity to the upper surface 178 of the first portion 30 of the trigger lever 16, and the first portion 54 of the lower surface 52 of the re-cocking lever 18. The interfering member on the lower portion 206 of the safety lever 201 can take a form other than the tab 222 in alternative embodiments.

The middle portion 204 of the safety lever 201 has an interfering member in the form of a tab 224 formed thereon. The tab 224 provides a third point of interference that inhibits the trigger assembly 10 from initiating the firing sequence when the safety lever 201 is in its locked position. The tab 224 extends through a slot 228 in the cover plate 14, as can be seen in FIG. 3. The safety lever 201 is configured so that the tab 224 becomes positioned directly below, and in close proximity to the lower surface 78 of the body 71 of the sear lever 20 when the safety lever 201 is moved to its locked position, as shown in FIGS. 13 and 14. The tab 224 thus interferes with clockwise movement of the sear lever 20.

As discussed above, the sear lever 20 must rotate in the clockwise direction, from the perspective of FIG. 11, to allow the transfer bar 21 to release the cocking piece 112 and initiate the firing sequence of the rifle 100. The safety lever 201, by preventing such rotation, thus inhibits initiation of the firing sequence at a third point within the linkage of the trigger assembly 10. This firing restriction can be removed by moving the safety lever 201 to the unlocked position shown in FIGS. 15 and 16, which causes the tab 224 to move generally rearward, and out of close proximity to the lower surface 78 of the body 71 of the sear lever 20. The interfering member on the mounting portion 204 of the safety lever 201 can take a form other than the tab 224 in alternative embodiments.

The safety mechanism 200, with one movement of the safety lever 201, thus provides a three point interlock that, when engaged, prevents the trigger assembly 10 from being actuated. The safety mechanism 200 thereby can provide an enhanced level of safety against an accidental discharge of the rifle 100 in comparison to a conventional safety having one, or even two points of interfering contact. Also, the safety mechanism 200 provides this three-point safety interlock without consuming any appreciable amount of space within the housing 12.

Bolt Release Lever

The trigger assembly 10 also includes a bolt release lever 140, shown in FIGS. 5 and 31A-31C. The bolt release lever 140 is configured to be mounted on and removed from the housing 12 manually, without the use of pins, screws, or other hardware external to the bolt release lever 140 and the housing 12, and without the use of any tooling whatsoever. This feature can reduce the overall parts count of the trigger assembly 10; can eliminate the potential installation difficulties arising from lost or misplaced fasteners; and can simplify and quicken installation and removal of the bolt release lever 140.

Figure 31A:
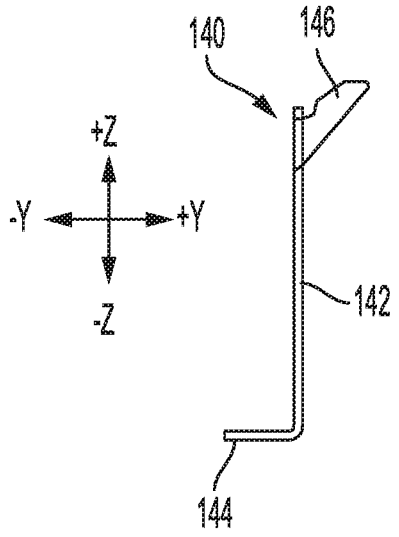
FIG. 31A is a front view of a bolt release lever of the trigger assembly shown in FIGS. 1-30.
Figure 31B:
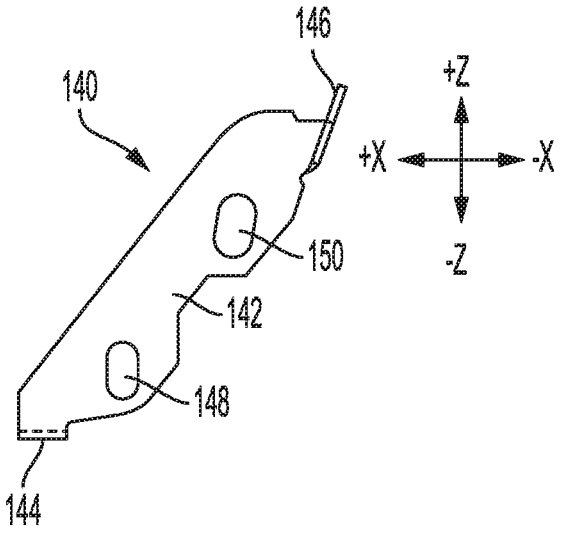
FIG. 31B is a side view of the bolt release lever shown in FIG. 31A.
Figure 31C:
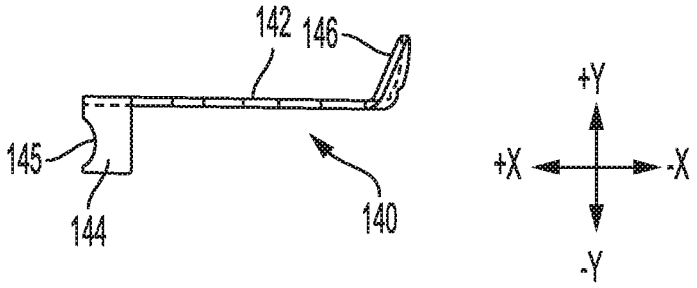
FIG. 31C is a bottom view of the bolt release lever shown in FIGS. 31A and 31B.

Referring the FIGS. 31A-31C, the bolt release lever 140 includes a body 142; a lower tab 144 that adjoins the lower end of the body 142; and an upper tab 146 that adjoins the body 142 proximate the upper end of the body 142. The lower tab 144 is oriented generally perpendicular to the body 142; and is located beneath the housing 12, forward of the trigger lever 16, when the bolt release lever 140 is installed on the housing 12. The lower tab 144 has a cutout 145 formed therein to provide access to the adjustment screw 89 associated with the trigger lever 16. The upper tab 146 is oriented generally perpendicular to the body 142; and extends away from the housing 12 when the bolt release lever 140 is installed on the housing 12.

The body 142 has a first, or lower slot 148 formed. The lower slot 148 is oriented so that its lengthwise axis extends substantially in the vertical, or "z" direction, when the bolt release lever 140 is installed on the housing 12. The body 142 also has a second, or upper slot 150 formed therein. The upper slot 150 is oriented so that its lengthwise axis extends substantially in the vertical, or "z" direction, when the bolt release lever 140 is installed on the housing 12.

Figure 5:
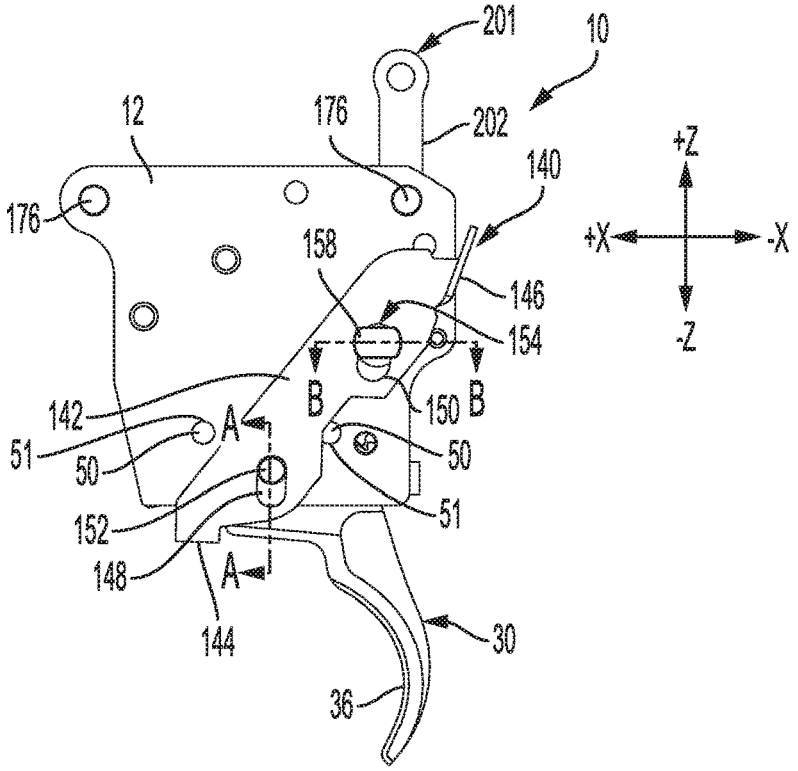
FIG. 5 is a left side view of the trigger assembly shown in FIGS. 2-4.
Figure 17:
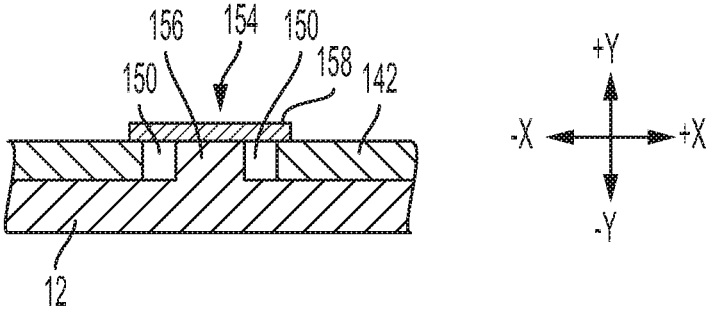
FIG. 17 is a cross-sectional view taken along the line "B-B" of FIG. 5.
Figure 18:
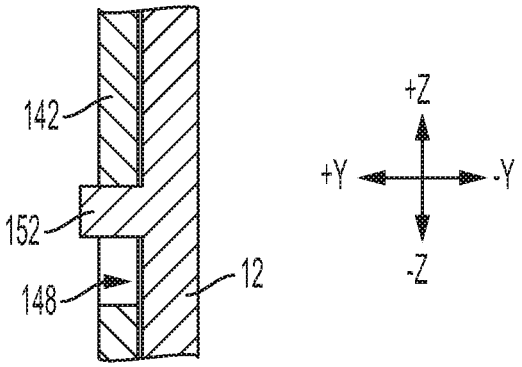
FIG. 18 is a cross-sectional view taken along the line "A-A" of FIG. 5.

Referring to FIGS. 5, 17, and 18, the housing 12 has a cylindrical first, or lower post 152 formed therein, proximate a lower end of the housing 12. The housing 12 also has a second, or upper post 154 formed therein, proximate a rearward end of the housing 12. The lower and upper posts 152, 154 can be formed separately from the housing, and can be secured to the housing 12 by an interference fit or other suitable means in alternative embodiments.

The upper post 154 has a cylindrical first portion 156 that adjoins the housing 12, and a second portion 158 that adjoins the first portion 156, as shown in FIG. 17. The second portion 158 has an elongated shape that substantially matches the shape of the upper slot 150. The elongated axis of the second portion 158 is oriented generally in the "x" direction. The second portion 158 is sized to permit the second portion 158 to fit within the upper slot 150 when the section portion 158 is aligned with the upper slot 150.

The bolt release lever 140 is installed on the housing 12 by orienting the bolt release lever 140 so that the orientation of the upper slot 150 matches that of the second portion 158 of the upper post 154; with the lower tab 144 located behind the housing 12. This orientation is angularly offset from the final, installed orientation of the bolt release lever 140 by approximately 90 degrees. The bolt release lever 140 is then moved toward the housing 12, so that the second portion 158 of the upper post 154 passes through the upper slot 150 as the body 142 nears the exterior surface of the housing 12.

The bolt release lever 140 is rotated in a clockwise direction, from the perspective of FIG. 5, after the second portion 158 of the upper post 154 has passed through the upper slot 150. The rotation of the bolt release lever 140 eventually brings the lower tab 144 into contact with lower portion of the trigger lever 16. The lower tab 144 and the body 142 can be deflected manually, generally in the "y" direction, at this point by applying pressure to the lower tab 144 and/or the body 142, to permit the lower tab 144 to clear the trigger lever 16 as the bolt release lever 140 is rotated further in the clockwise direction. The resilience of the relatively thin body 142 allows the body 142 to bend, and to then return to its original undeflected state once the external pressure is removed from the bolt release lever 140.

Subsequent clockwise rotation of the bolt release lever 140 causes the body 142 to contact the lower post 152. The lower tab 144 and the body 142 again can be deflected manually, generally in the "y" direction, to permit the body 142 to clear the lower post 152, and the bolt release lever 140 can be further rotated until the lower slot 148 aligns with the lower post 152. At this point, the external pressure can be removed from the bolt release lever 140, the body 142 will return to its undeflected state, and the lower post 152 will become disposed in the lower slot 148 as shown in FIG. 18, thereby completing installation of the bolt release lever 140.

When the bolt release lever 140 is installed on the housing 12, the elongated axis of the upper slot 150 is substantially perpendicular to elongated axis of the second portion 158 of the upper post 154 as can be seen in FIG. 5; and interference between the second portion 158 and the adjacent portion of the body 142 retains the bolt release lever 140 on the housing 12.

The bolt release lever 140, upon installation, is ready to perform is intended function of releasing the bolt assembly 102. Specifically, the bolt release lever 140 can be moved upward, within the range of travel permitted by the lower and upper slots 148, 150, by pressing the lower tab 144. The upward movement of the bolt release lever 140 causes the upper tab 146 to contact, and rotate the bolt stop of the rifle 100, at which point the bolt stop no longer blocks rearward movement of the bolt assembly 102, allowing the bolt assembly 102 to be drawn rearward, out of the receiver 103.

The bolt release lever 140 can be removed from the housing 12 by performing the above-described installation procedure in reverse order. The upper slot 150 and the second portion 158 of the upper post 154 can have non-rounded shapes other than those depicted in the figures, in alternative embodiments.

PARTS LIST trigger assembly 10
housing 12
cover plate 14
trigger lever 16
re-cocking lever (second lever) 18
sear lever (third lever) 20
transfer bar (fourth lever) 21
lower surface 22 of transfer bar 21
forward surface 23 of transfer bar 21
first portion 24 of forward surface 23
second portion 25 of forward surface 23
third portion 26 of forward surface 23
upper surface 27 of transfer bar 21
first portion 28 of upper surface 27
second portion 29 of upper surface 27
first portion 30 of trigger lever 16
rear surface 31 of transfer bar 21
second portion 32 of trigger lever 16
second portion 33 of rear surface 31
third portion 34 of trigger lever 16
surface 36 of first portion 30
first portion 37 of rear surface 31
third portion 38 of upper surface 27
passages 40 in second portion 32
first adjustment screw 42*a*
second adjustment screw 42*b*
upper ends 43 of first and second adjustment screw 42*a*, 42*b*
lower ends 44 of first and second adjustment screws 42*a*, 42*b*
recesses 45 in lower ends 44
lower surface 46 of the second portion 32
upper surface 47 of second portion 32
ball 48
apertures 49
pins 50
apertures 51
lower surface 52 of re-cocking lever 18
first portion 54 of lower surface 52
second portion 56 of lower surface 52
third portion 58 of lower surface 52
fourth portion 59 of lower surface 52
adjustment screw 62
detent 63
upper surface 64 of re-cocking lever 18
first portion 65 of upper surface 64
second portion 66 of upper surface 64
third portion 67 of upper surface 64
fourth portion 68 of upper surface 64
fifth portion 69 of upper surface 64
sixth portion 70 of upper surface 64
body 71 of sear lever 20
arm 72 of sear lever 20
lower end 73 of arm 72
contact surface 74 of lower end 73
upper surface 75 of body 71
lower surface 78 of body 71
passage 83 in housing 12
adjustment screw 84
lower end 85 of adjustment screw 84
spring 86
passage 87 in housing 12
ball 88
adjustment screw 89
alignment posts 90 of housing 12
apertures 91 in cover plate 14
aperture 92 in cover plate 14
spring 93
passage 94 in housing 12
ball 95
internal passages 96 in housing 12
port 97 in housing 12
channel portion 99 in detent 63
rifle 100
action 101
bolt assembly 102
receiver 103
striker 105
firing pin 106
bolt shroud 110
cocking piece 112
bolt body 113
bolt handle 115
stock 120
a loading ejection port 125
magazine 126
lip 127 of cocking piece 112
barrel 130
contact surface 134 on cocking piece 112
muzzle 138
bolt release lever 140
body 142 of bolt release lever 140
lower tab 144 of bolt release lever 140
cutout 145 in lower tab 144
upper tab 146 of bolt release lever 140
lower slot 148 in body 142
upper slot 150 in body 142
lower post 152 of housing 12
upper post 154 of housing 12
first portion 156 of upper post 154
second portion 158 of upper post 154
surface 160 of housing 12
surface 162 of housing 12
lower surface 170 of third portion 34
upper surface 172 of the third portion 34
spring 174
passage 175 in housing 12
apertures 176 in housing 12 and cover plate 14
upper surface 178 of first portion 30
interior surface 180 of housing 12
raised areas 181 of housing 12 and cover plate 14
interior surface 182 of cover plate 14
safety mechanism 200 safety lever 201
upper (first) portion 202 of safety lever 201
middle (second) portion 204 of safety lever 201
lower (third) portion 206 of safety lever 201
projections 207 on cover plate 14
projection 208 on cover plate 14
knob 209 on upper portion 202
tab 212
arms 213 of second tab 210
tab 216
tab 217
guide 218
inner surface 220 of guide 218
lip 221 of guide 218
tab 222 on safety lever 201
tab 224 on safety lever 201
slot 228 in cover plate 14

We claim:

1. A trigger assembly for restraining a firing pin of a firearm on a selective basis, comprising:

a housing;

a first lever mounted for rotation on the housing and movable between a first and a second angular position of the first lever;

a second lever mounted for rotation on the housing and movable between a first and a second angular position of the second lever, wherein the first lever is configured to move the second lever from the first to the second angular position of the second lever when the first lever moves from the first to the second angular position of the first lever, and a first and a second adjustment screw mounted on the first lever; wherein the first lever is further configured to move the second lever from the first to the second angular position of the second lever via at least one of the first and the second adjustment screws; and the second lever and the second adjustment screw are configured so that a distance between an axis of rotation of the second lever and a point of contact between the second lever and the second adjustment screw decreases as the second lever rotates from the first angular position of the second lever and toward the second angular position of the second lever.

2. The trigger assembly of claim 1, wherein:

the second lever is configured so that an end of the second lever contacts the second adjustment screw at a location on the second adjustment screw between the axis of rotation of the second lever and a centerline of the second adjustment screw;

the second adjustment screw has an end portion having a rounded upper surface; and the second lever is configured so that the end of the second lever slides along the upper surface when the second lever rotates from the first angular position of the second lever and toward the second angular position of the second lever.

3. The trigger assembly of claim 2, wherein:

the first lever has a first and a second portion;

the first and second adjustment screws are mounted on the second portion of the first lever;

the first portion of the first lever extends in a downward direction from the second portion of the first lever and has a substantially flat, forward-facing surface configured to act as a contact surface against which a user can exert pressure to rotate the first lever; and the second adjustment screw is configured to be positioned so that a point of contact between the second lever and the second adjustment screw is lower, with respect to the downward direction, than the respective axes of rotation of the first and second levers when the first and second levers are in their respective first positions.

4. The trigger assembly of claim 3, wherein the second adjustment screw is further configured to be positioned so that a lengthwise axis of the second lever is tilted downward when the second lever is in the first position of the second lever.

5. The trigger assembly of claim 4, wherein the first adjustment screw is configured to be positioned so that the first adjustment screw comes into contact with the second lever when the lengthwise axis of the second lever is in an approximately level orientation with respect to the forward direction.

6. The trigger assembly of claim 1, wherein the first lever is configured to rotate from the first to the second angular position of the first lever in a first direction; and the second lever is configured to rotate from the first to the second angular position of the second lever in a second direction, the second direction being opposite the first direction.

7. The trigger assembly of claim 1, wherein the second lever is configured so that a ratio of an angular displacement of the second lever to an angular displacement of the first lever increases through at least an initial portion of the movement of the first lever from the first angular position to the second angular position of the first lever.

8. The trigger assembly of claim 2, wherein the second lever is further configured so that the end of the second lever slides away from the centerline of the second adjustment screw when the second lever rotates from the first angular position of the second lever and toward the second angular position of the second lever.

9. The trigger assembly of claim 1, wherein the first and the second adjustment screws are configured to be positioned so that the second adjustment screw contacts the second lever during at least an initial portion of the movement of the second lever from the first to the second angular position of the second lever; and the first adjustment screw contacts the second lever during at least a final portion of the movement of the second lever from the first to the second angular position of the second lever.

10. The trigger assembly of claim 1, wherein the first lever is a trigger lever and the second lever is a re-cocking lever.

11. The trigger assembly of claim 1, wherein the first adjustment screw is configured so that a position of the first adjustment screw in relation to the first lever is adjustable; and the second adjustment screw is configured so that a position of the second adjustment screw in relation to the first lever is adjustable.

12. A firearm comprising the trigger assembly of claim 1.

* * * * *